US009818347B2

(12) United States Patent
Uriostigue et al.

(10) Patent No.: US 9,818,347 B2
(45) Date of Patent: Nov. 14, 2017

(54) DISPLAY APPARATUS INCLUDING SELF-TUNING CIRCUITS FOR CONTROLLING LIGHT MODULATORS

(71) Applicant: SnapTrack, Inc., San Diego, CA (US)

(72) Inventors: Eric Uriostigue, San Diego, CA (US); Alan Gerald Lewis, Sunnyvale, CA (US); Mark Milenko Todorovich, San Diego, CA (US); Pramod Varma, San Diego, CA (US); Paul Penchin Pan, San Diego, CA (US)

(73) Assignee: SnapTrack, Inc., San Diego, CA (US)

( * ) Notice: Subject to any disclaimer, the term of this patent is extended or adjusted under 35 U.S.C. 154(b) by 114 days.

(21) Appl. No.: 15/084,371

(22) Filed: Mar. 29, 2016

(65) Prior Publication Data

US 2017/0287414 A1 Oct. 5, 2017

(51) Int. Cl.
*G09G 3/34* (2006.01)
*G09G 3/20* (2006.01)

(52) U.S. Cl.
CPC ..... *G09G 3/3433* (2013.01); *G09G 3/2003* (2013.01); *G09G 2300/0814* (2013.01); *G09G 2310/0262* (2013.01); *G09G 2310/0289* (2013.01); *G09G 2320/0646* (2013.01); *G09G 2360/144* (2013.01)

(58) Field of Classification Search
CPC .. G09G 3/3493; G09G 3/3433; G09G 3/2003; G09G 2320/0646; G09G 2310/0289; G09G 2300/0814; G09G 2360/144; G09G 2310/0262
See application file for complete search history.

(56) References Cited

U.S. PATENT DOCUMENTS

2009/0204349 A1 8/2009 Govil et al.
2013/0069929 A1 3/2013 English et al.
2013/0176611 A1* 7/2013 Lewis ..... G09G 3/3433 359/291
2013/0328749 A1 12/2013 Jamal et al.
2014/0268273 A1 9/2014 Brosnihan et al.
2014/0292738 A1* 10/2014 Yao ..... G09G 3/3433 345/212
2014/0333598 A1 11/2014 Shi et al.
2015/0108479 A1 4/2015 Brinkley et al.
2015/0192634 A1 7/2015 Lewis et al.

OTHER PUBLICATIONS

International Search Report and Written Opinion—PCT/US2017/019164—ISA/EPO—May 30, 2017.

* cited by examiner

*Primary Examiner* — Adam R Giesy
(74) *Attorney, Agent, or Firm* — Foley & Lardner LLP

(57) ABSTRACT

This disclosure provides systems, methods and apparatus for controlling the states of a light modulator used in displays. A display apparatus includes pixel circuits coupled to the light modulators. Each pixel circuit can include an output node, a data capacitor, a charge transistor for charging the output node and a discharge transistor for selectively conducting a current between the output node and an update interconnect providing an update voltage. The display apparatus can include a controller for testing the pixel circuits to determine two or more update voltage levels, each update voltage level causing the discharge transistor to conduct current. The controller also can be configured to determine a logical high voltage level to be stored in the data capacitor based on the plurality of update voltage levels.

24 Claims, 12 Drawing Sheets

DISPLAY APPARATUS INCLUDING SELF-TUNING CIRCUITS FOR CONTROLLING LIGHT MODULATORS

TECHNICAL FIELD

This disclosure relates to the field of imaging displays, and in particular to methods and systems for calibrating display operating voltages.

DESCRIPTION OF THE RELATED TECHNOLOGY

Electromechanical systems (EMS) include devices having electrical and mechanical elements, actuators, transducers, sensors, optical components such as mirrors and optical films, and electronics. EMS devices or elements can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using one or more of deposition, etching, lithography, and other micromachining processes that etch away parts of one or more of substrates and deposited material layers, or that add layers to form electrical and electromechanical devices.

EMS-based display apparatus can include display elements that modulate light by selectively moving a light blocking component into and out of an optical path through an aperture defined through a light blocking layer. Doing so selectively passes light from a backlight or reflects light from the ambient or a front light to form an image.

SUMMARY

The systems, methods and devices of this disclosure each have several innovative aspects, no single one of which is solely responsible for the desirable attributes disclosed herein.

One innovative aspect of the subject matter described in this disclosure can be implemented in a display apparatus including a plurality of light modulators, a plurality of pixel circuits, an update interconnect driver and a controller. The plurality of light modulators are capable of selectively allowing passage of light. Each of the plurality of pixel circuits includes an output node coupled to a corresponding light modulator of the plurality of light modulators, a charge transistor capable of charging the output node from an actuation interconnect, and a discharge transistor capable of selectively conducting a current between the output node and an update interconnect. The update interconnect driver is capable of outputting voltages to the update interconnects of the plurality of pixel circuits. The controller can be coupled to the plurality of pixel circuits and is capable of determining a low update voltage to apply to the update interconnects by causing the charge transistors of the plurality of pixel circuits to enter a conductive state, and while the charge transistors of the plurality of pixel circuits are in the conductive state, determining a plurality of voltage levels provided to the update interconnects that cause the discharge transistor of at least one of the plurality of pixel circuits to conduct current.

In some implementations, the display apparatus further includes a current sensor coupled to the controller for sensing a level of the current flowing through at least one of the update interconnects and the actuation interconnect and providing the level to the controller. In some implementations, the plurality of update voltage levels provided to the update interconnect include a first voltage level of the plurality of voltage levels provided to the update interconnects determined while a logical low data voltage is applied to the gates of the discharge transistors of the plurality of pixel circuits, and a second voltage level of the plurality of voltage levels provided to the update interconnects determined while a logical high data voltage is applied to the gates of the discharge transistors of a portion of the plurality of pixel circuits. In some implementations, the low update voltage is determined to be a voltage between the first voltage level and the second voltage level.

In some implementations, the controller is further capable of controlling the update interconnect driver to output a voltage on the update interconnects that switches OFF the discharge transistors of the plurality of pixel circuits, controlling the update interconnect driver to incrementally reduce the voltage on the update interconnects to a first turn-on voltage that causes a level of current flowing through at least one of the update interconnects and the actuation interconnect to be equal to or greater than a first actuation current threshold, and setting the first voltage level based on the first turn-on voltage.

In some such implementations, the voltage output by the update interconnect driver prior to the incremental reduction in voltage is substantially equal to the logical low data voltage. In some other such implementations, the controller is further capable of setting the first voltage level to a sum of the first turn-on voltage and a first adjustment voltage.

In some implementations, the display apparatus further includes a current source coupled to the update interconnects of the plurality of pixel circuits where the controller is further capable of controlling the current source to draw a test current, and setting the first voltage level based on a voltage on the update interconnects corresponding to the test current. In some implementations, the controller is further capable of determining the second voltage level by sequentially, across a plurality of portions of the plurality of pixel circuits, applying the logical high data voltage to the gates of discharge transistors of a respective portion of the plurality of pixel circuits, and determining a maximum update voltage at which one or more of the discharge transistors of the pixel circuits in the respective portion of the plurality of pixel circuits are conductive. The controller is further capable of setting the lowest voltage of the determined maximum update voltages as the second voltage level.

In some implementations, the controller is further capable of determining the second voltage level by sequentially, across a plurality of portions of the plurality of pixel circuits, applying the logical high data voltage to the gates of discharge transistors of a respective portion of the plurality of pixel circuits, controlling the current source to draw a test current from the respective portion of the plurality of pixel circuits, and measuring a maximum update voltage at the update interconnects of the respective portion of plurality of pixel circuits. The controller is further capable of setting the second voltage level based on the lowest voltage of the measured maximum update voltages. In some implementations, when testing the respective portion of the plurality of pixel circuits, the controller is further capable of applying the logical low data voltage to the gates of the discharge transistors of those pixel circuits that do not belong to the respective portion of the plurality of pixel circuits.

In some implementations, the controller is further capable of utilizing the first voltage level and the second voltage level to determine a logical high data voltage level. In some such implementations, the controller is further capable of determining the logical high data voltage level by determining a range of update voltages based on a difference between the first voltage level and the second voltage level. The controller is further capable of determining the logical high data voltage level by determining a revised logical high data voltage level by sequentially, until an absolute difference between the range of update voltages and a target range is less than a voltage threshold, adjusting a current value of the logical high data voltage based on the difference between the range of update voltages and the target range from a current value of the logical high data voltage level to generate a revised logical high data voltage level, re-determining the second voltage level by using the revised logical high data voltage for applying to the gates of the discharge transistors of the respective portions of the plurality of pixel circuits, and re-determining the range of update voltages. The controller is further capable of determining the logical high data voltage level by setting the revised logical high data voltage as the logical high data voltage level.

In some implementations, the plurality of update voltage levels provided to the update interconnects includes a first voltage and a second voltage of the plurality of voltage levels provided to the update interconnects. In some such implementations, the first voltage is the lowest voltage level for which none of the discharge transistors of the plurality of pixel circuits conducts a sufficient current to discharge the respective output nodes when a logical low data voltage is applied to the gates of the discharge transistors of the plurality of pixel circuits. In some such implementations, the second voltage level is a highest voltage level for which all the discharge transistors of the plurality of pixel circuits conduct sufficient current to discharge the respective output nodes when a logical high data voltage is applied to the gates of the discharge transistors of the plurality of pixel circuits. In some such implementations, the low update voltage is determined to be a voltage between the first voltage level and the second voltage level.

In some implementations, the display apparatus further includes a display including the plurality of light modulators, the update interconnects, the plurality of pixel circuits, and the controller. The display apparatus further includes a processor that is capable of communicating with the display, the processor being capable of processing image data, and a memory device that is capable of communicating with the processor. In some implementations, the display apparatus the display further includes a driver circuit capable of sending at least one signal to the display, and where the controller is further capable of sending at least a portion of the image data to the driver circuit. In some implementations, the display apparatus further includes an image source module capable of sending the image data to the processor, where the image source module includes at least one of a receiver, transceiver, and transmitter. In some implementations, the display further includes an input device capable of receiving input data and to communicate the input data to the processor.

Another innovative aspect of the subject matter described in this disclosure can be implemented in a method for testing a display apparatus including a plurality of pixel circuits, each of the plurality of pixel circuits having an output node coupled to one of a plurality of light modulators, a charge transistor capable of charging the output node and a discharge transistor capable of selectively conducting a current between the output node and an update interconnect. The method includes causing the charge transistors of the plurality of pixel circuits to enter a conductive state. The method further includes, while the charge transistors of the plurality of pixel circuits are in the conductive state, determining a plurality of voltage levels provided to the update interconnects that cause the discharge transistor of at least one of the plurality of pixel circuits to conduct current. The method also includes processing the determined plurality of voltage levels to determine a low update voltage for applying to the update interconnects of the plurality of pixel circuits.

In some implementations, determining a plurality of voltage levels provided to the update interconnects includes determining a first voltage level of the plurality of voltage levels provided to the update interconnects when a logical low data voltage is applied to the gates of the discharge transistors of the plurality of pixel circuits. In some implementations, determining a plurality of voltage levels provided to the update interconnects also includes determining a second voltage level of the plurality of voltage levels provided to the update interconnects when a data voltage corresponding to a logical high data is stored in the first subset of the plurality of pixel circuits. In some implementations, processing the determined plurality of update voltage levels to determine a low update voltage for applying to the update interconnect includes equating the low update voltage to a voltage between the first voltage level and the second voltage level.

In some implementations, determining the first voltage level includes applying an update voltage to the update interconnects that substantially switches OFF the discharge transistors of the plurality of pixel circuits, incrementally reducing the update voltage on the update interconnects to a first turn-on voltage that causes a level of current flowing through at least one of the update interconnects and the actuation interconnect to be equal to or greater than a first actuation current threshold, and setting the first voltage level based on the first turn-on voltage.

In some implementations, determining the first voltage level includes drawing a test current from the update interconnects and measuring a voltage at the update interconnects corresponding to the test current, and setting the first voltage level based on the measured voltage. In some implementations, determining the second voltage level includes, for each portion of the plurality of pixel circuits, applying a logical high data voltage to the gates of discharge transistors of a respective portion of the plurality of pixel circuits, and determining a maximum update voltage at which one or more of the discharge transistors of the pixel circuits in the respective portions of the pixel circuits are conductive. In some implementations, determining the second voltage level further includes setting the lowest voltage of the determined maximum update voltages as the second voltage level.

In some implementations, the method further includes utilizing the first voltage level and the second voltage level to determine a logical high data voltage level for use in addressing the plurality of pixel circuits. In some implementations, the method further includes determining a range of update voltages based on a difference between the first voltage level and the second voltage level. In some implementations, the method also includes determining a revised logical high data voltage level by iteratively, until the difference between the range of update voltages and a target range is less than a voltage threshold, adjusting a current value of the logical high data voltage based on the difference between the range of update voltages and the target voltage from a current value of the logical high data voltage level to generate a revised logical high data voltage level, re-determining the second voltage level by using the revised logical high data voltage for applying to the gates of the discharge transistors of the respective portions of the plurality of pixel circuits, and re-determining the range of update voltages. In some implementations, the method further includes setting the revised logical high data voltage as the logical high data voltage level.

In some implementations, processing the determined plurality of voltage levels to determine a logical high data voltage level for use in addressing the plurality of pixel circuits includes addressing the plurality of pixel circuits by storing the logical high data voltage in a data capacitor coupled to the gates of the discharge transistors.

Details of one or more implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
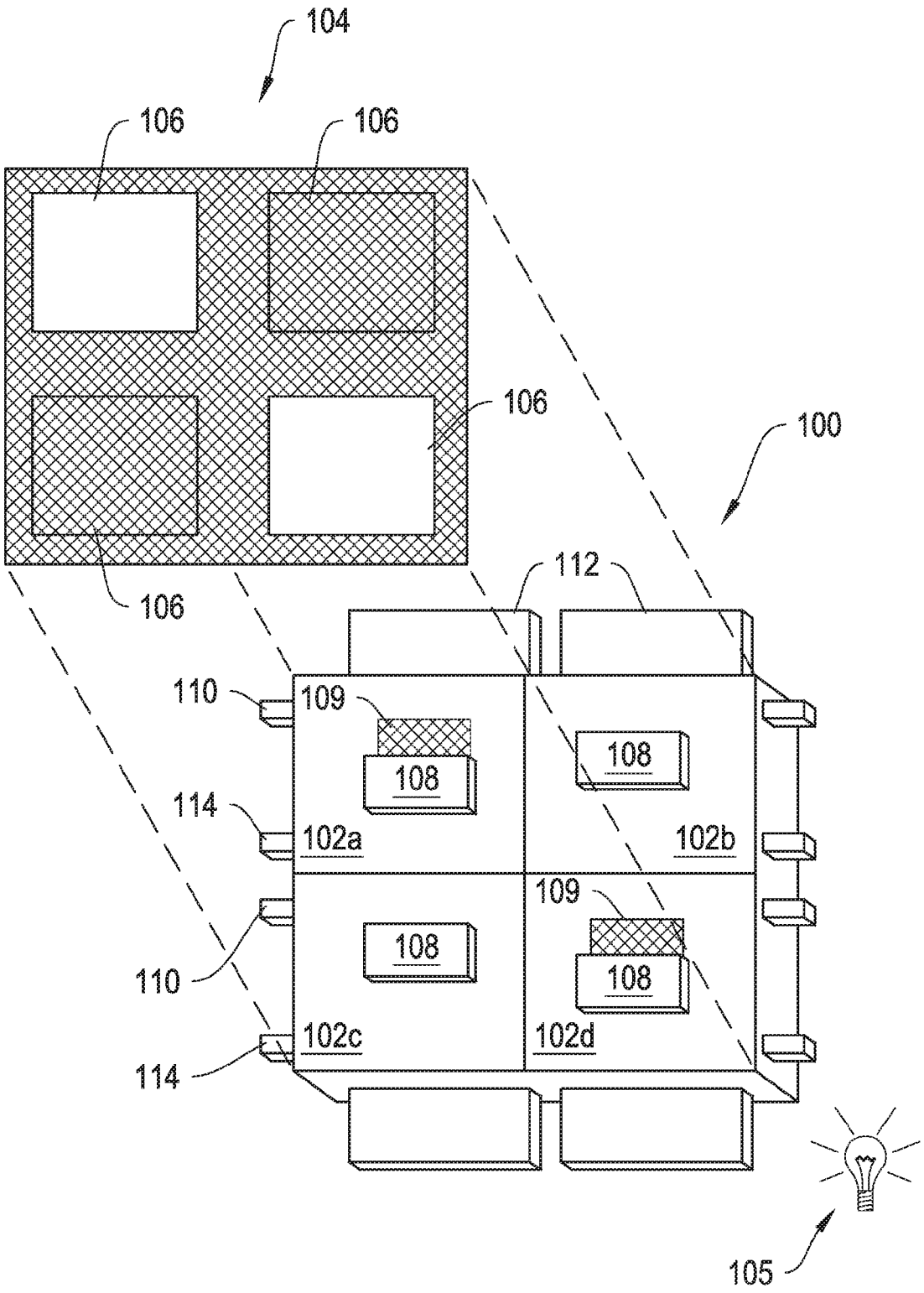
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that is capable of displaying an image, whether in motion (such as video) or stationary (such as still images), and whether textual, graphical or pictorial. The concepts and examples provided in this disclosure may be applicable to a variety of displays, such as liquid crystal displays (LCDs), organic light-emitting diode (OLED) displays, field emission displays, and electromechanical systems (EMS) and microelectromechanical (MEMS)-based displays, in addition to displays incorporating features from one or more display technologies.

The described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, wearable devices, clocks, calculators, television monitors, flat panel displays, electronic reading devices (such as e-readers), computer monitors, auto displays (such as odometer and speedometer displays), cockpit controls, cockpit displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, in addition to non-EMS applications), aesthetic structures (such as display of images on a piece of jewelry or clothing) and a variety of EMS devices.

The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

A display apparatus includes pixel circuits for controlling the state of operation of dual actuator light modulators. In some implementations, each pixel circuit can include an output node coupled to its respective light modulator. The pixel circuit can include a data capacitor for storing a data voltage corresponding to either logical high or logical low data. The pixel circuit also can include a charge transistor for charging the output node, and a discharge transistor for selectively discharging the output node. In some implementations, the source terminal and the drain terminal of the discharge transistor can be connected to an update interconnect and the output node, respectively. An update voltage on the update interconnect can be lowered to enable the discharge transistor to selectively discharge the output node based on the data voltage stored on the data capacitor.

In some implementations, the display apparatus can include a controller for controlling the operation of the display apparatus and for tuning the pixel circuits. In some implementations, the controller can test the display apparatus to determine a minimum low update voltage and a maximum low update voltage. In some implementations, determining the minimum low update voltage can include reducing the update voltage on the update interconnect from an initial value that is substantially equal to a data voltage corresponding to logical a low data value stored in the data capacitor. In some other implementations, determining the minimum low update voltage can include drawing a test current from the pixel circuit while storing a logical low voltage in the data capacitor, and measuring the voltage, corresponding to the test current, at the update interconnect. The minimum low update voltage can be estimated based on the measured voltage. In some implementations, determining the maximum low update voltage can include reducing the update voltage on the update interconnect from an initial value that is substantially equal to a data voltage corresponding to a logical high data value stored in the data capacitor. In some other implementations, determining the maximum low update voltage can include drawing a test current through the pixel circuit while storing a logical high voltage in the data capacitor, and measuring the voltage, corresponding to the test current, at the update interconnect. The maximum low update voltage can be estimated based on the measured voltage. In some implementations, determining the maximum low update voltage can include determining the maximum update voltage for two or more subsets of the total number of pixel circuits in the display apparatus.

In some implementations, the controller can utilize the estimated values of the minimum low update voltage and the maximum low update voltage to determine a lowest data voltage needed for the appropriate operation of the display apparatus. For example, the lowest appropriate data voltage can be determined based on the difference between the maximum low update voltage and the minimum low update voltage. In some implementations, the controller can determine the data voltage in various situations, such as at display apparatus start-up, in response to changes in ambient light conditions, or in response to changes in temperature.

Particular implementations of the subject matter described in this disclosure can be implemented to realize one or more of the following potential advantages. By testing the display apparatus to determine appropriate update and data voltages to be provided to pixel circuits, the applied voltages can be tuned to account for changes in the transistor characteristics of the pixel circuits, which can vary over time and across varying operating conditions. In particular, by tuning the low update and high data voltages utilized in the display apparatus, failures resulting from transistor characteristics that may vary due to aging, changing temperatures, and changing ambient light conditions, can be reduced or mitigated. In some implementations, the high data voltage can be tuned to, or to about, the lowest logical high data voltage that provides appropriate operation of the display apparatus, thereby reducing the power consumption of the display devices. By testing for maximum low update voltages over different portions of the display apparatus, non-uniformity in transistor characteristics due to process variations or other causes across the display apparatus can be taken into account to determine the appropriate low update voltage and the lowest logical high data voltages. In some implementations, testing the display apparatus can improve the yield of the display. For example, in some implementations, displays that may fail to operate fully or partially using typical update and data voltage values can be tuned to determine the appropriate update and data voltage values that ensure correct operation, thereby improving the yield of the displays.

FIG. 1A shows a schematic diagram of an example direct-view MEMS-based display apparatus 100. The display apparatus 100 includes a plurality of light modulators 102*a*-102*d* (generally light modulators 102) arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide a luminance level in an image 104. With respect to an image, a pixel corresponds to the smallest picture element defined by the resolution of image. With respect to structural components of the display apparatus 100, the term pixel refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the image can be seen by looking directly at the display apparatus, which contains the light modulators and optionally a backlight or front light for enhancing brightness, enhancing contrast, or enhancing both brightness and contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a light guide or backlight so that each pixel can be uniformly illuminated. Transmissive direct-view displays are often built onto transparent substrates to facilitate a sandwich assembly arrangement where one substrate, containing the light modulators, is positioned over the backlight. In some implementations, the transparent substrate can be a glass substrate (sometimes referred to as a glass plate or panel), or a plastic substrate. The glass substrate may be or include, for example, a borosilicate glass, fused silica, a soda lime glass, quartz, artificial quartz, Pyrex, or other suitable glass material.

Each light modulator 102 can include a shutter 108 and an aperture 109. To illuminate a pixel 106 in the image 104, the shutter 108 is positioned such that it allows light to pass through the aperture 109. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix coupled to the substrate and to the light modulators for controlling the movement of the shutters. The control matrix includes a series of electrical interconnects (such as interconnects 110, 112 and 114), including at least one write-enable interconnect 110 (also referred to as a scan line interconnect) per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the write-enabling voltage, $V_{WE}$), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate drive voltages, which are typically higher in magnitude than the data voltages, to the light modulators 102. The application of these drive voltages results in the electrostatic driven movement of the shutters 108.

The control matrix also may include, without limitation, circuitry, such as a transistor and a capacitor associated with each shutter assembly. In some implementations, the gate of each transistor can be electrically connected to a scan line interconnect. In some implementations, the source of each transistor can be electrically connected to a corresponding data interconnect. In some implementations, the drain of each transistor may be electrically connected in parallel to an electrode of a corresponding capacitor and to an electrode of a corresponding actuator. In some implementations, the other electrode of the capacitor and the actuator associated with each shutter assembly may be connected to a common or ground potential. In some other implementations, the transistor can be replaced with a semiconducting diode, or a metal-insulator-metal switching element.

Figure 1B:
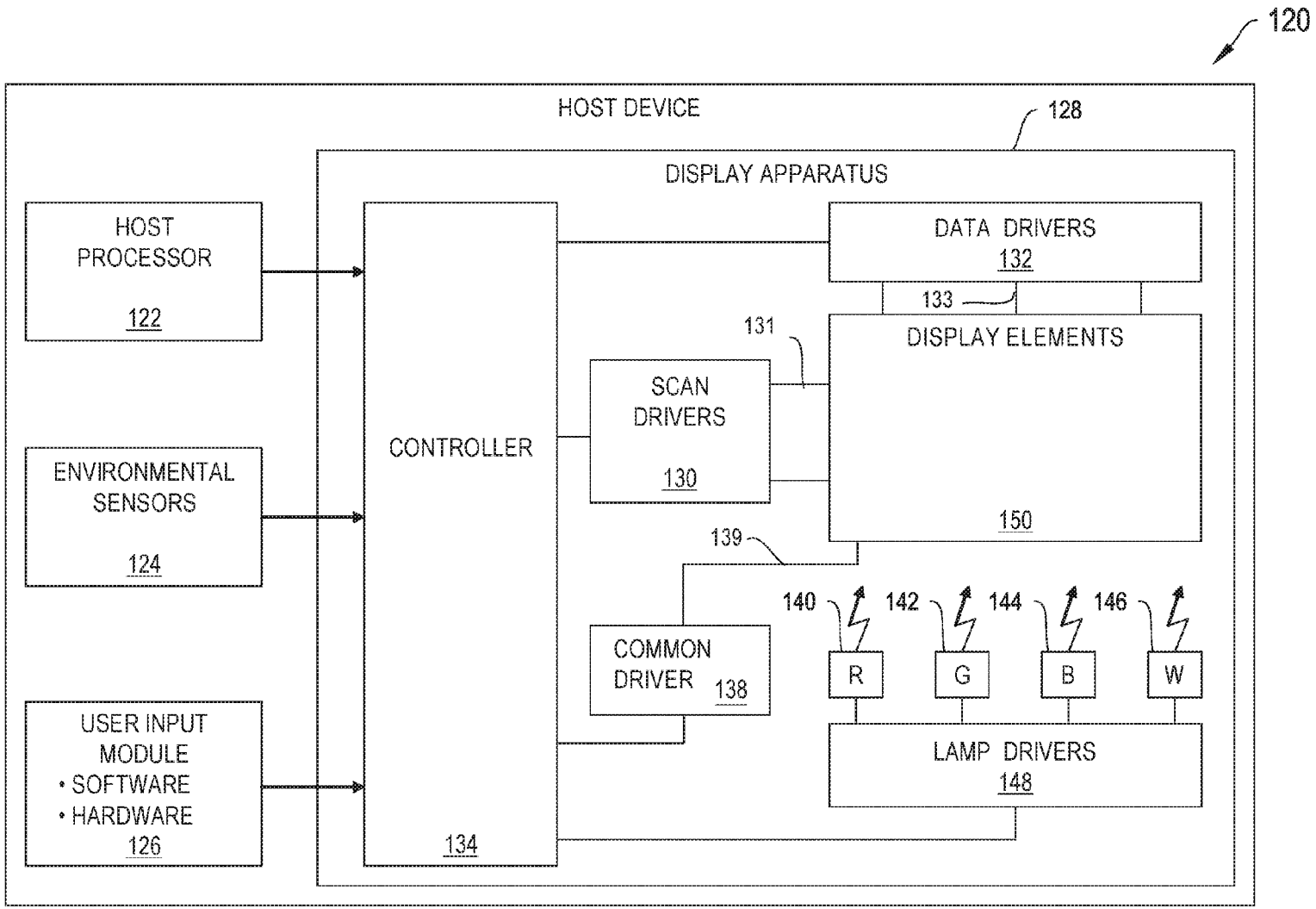
FIG. 1B shows a block diagram of an example host device.

FIG. 1B shows a block diagram of an example host device 120 (i.e., cell phone, smart phone, PDA, MP3 player, tablet, e-reader, netbook, notebook, watch, wearable device, laptop, television, or other electronic device). The host device 120 includes a display apparatus 128 (such as the display apparatus 100 shown in FIG. 1A), a host processor 122, environmental sensors 124, a user input module 126, and a power source.

The display apparatus 128 includes a plurality of scan drivers 130 (also referred to as write enabling voltage sources), a plurality of data drivers 132 (also referred to as data voltage sources), a controller 134, common drivers 138, lamps 140-146, lamp drivers 148 and an array of display elements 150, such as the light modulators 102 shown in FIG. 1A. The scan drivers 130 apply write enabling voltages to scan line interconnects 131. The data drivers 132 apply data voltages to the data interconnects 133.

In some implementations of the display apparatus, the data drivers 132 are capable of providing analog data voltages to the array of display elements 150, especially where the luminance level of the image is to be derived in analog fashion. In analog operation, the display elements are designed such that when a range of intermediate voltages is applied through the data interconnects 133, there results a range of intermediate illumination states or luminance levels in the resulting image. In some other implementations, the data drivers 132 are capable of applying a reduced set, such as 2, 3 or 4, of digital voltage levels to the data interconnects 133. In implementations in which the display elements are shutter-based light modulators, such as the light modulators 102 shown in FIG. 1A, these voltage levels are designed to set, in digital fashion, an open state, a closed state, or other discrete state to each of the shutters 108. In some implementations, the drivers are capable of switching between analog and digital modes.

The scan drivers 130 and the data drivers 132 are connected to a digital controller circuit 134 (also referred to as the controller 134). The controller 134 sends data to the data drivers 132 in a mostly serial fashion, organized in sequences, which in some implementations may be predetermined, grouped by rows and by image frames. The data drivers 132 can include series-to-parallel data converters, level-shifting, and for some applications digital-to-analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 139. In some other implementations, the common drivers 138, following commands from the controller 134, issue voltage pulses or signals to the array of display elements 150, for instance global actuation pulses which are capable of driving, initiating, or both driving and initiating simultaneous actuation of all display elements in multiple rows and columns of the array.

Each of the drivers (such as scan drivers 130, data drivers 132 and common drivers 138) for different display functions can be time-synchronized by the controller 134. Timing commands from the controller 134 coordinate the illumination of red, green, blue and white lamps (140, 142, 144 and 146 respectively) via lamp drivers 148, the write-enabling and sequencing of specific rows within the array of display elements 150, the output of voltages from the data drivers 132, and the output of voltages that provide for display element actuation. In some implementations, the lamps are light emitting diodes (LEDs).

The controller 134 determines the sequencing or addressing scheme by which each of the display elements can be re-set to the illumination levels appropriate to a new image 104. New images 104 can be set at periodic intervals. For instance, for video displays, color images or frames of video are refreshed at frequencies ranging from 10 to 300 Hertz (Hz). In some implementations, the setting of an image frame to the array of display elements 150 is synchronized with the illumination of the lamps 140, 142, 144 and 146 such that alternate image frames are illuminated with an alternating series of colors, such as red, green, blue and white. The image frames for each respective color are referred to as color subframes. In this method, referred to as the field sequential color method, if the color subframes are alternated at frequencies in excess of 20 Hz, the human visual system (HVS) will average the alternating frame images into the perception of an image having a broad and continuous range of colors. In some other implementations, the lamps can employ primary colors other than red, green, blue and white. In some implementations, fewer than four, or more than four lamps with primary colors can be employed in the display apparatus 128.

In some implementations, where the display apparatus 128 is designed for the digital switching of shutters, such as the shutters 108 shown in FIG. 1A, between open and closed states, the controller 134 forms an image by the method of time division gray scale. In some other implementations, the display apparatus 128 can provide gray scale through the use of multiple display elements per pixel.

In some implementations, the data for an image state is loaded by the controller 134 to the array of display elements 150 by a sequential addressing of individual rows, also referred to as scan lines. For each row or scan line in the sequence, the scan driver 130 applies a write-enable voltage to the write enable interconnect 131 for that row of the array of display elements 150, and subsequently the data driver 132 supplies data voltages, corresponding to desired shutter states, for each column in the selected row of the array. This addressing process can repeat until data has been loaded for all rows in the array of display elements 150. In some implementations, the sequence of selected rows for data loading is linear, proceeding from top to bottom in the array of display elements 150. In some other implementations, the sequence of selected rows is pseudo-randomized, in order to mitigate potential visual artifacts. And in some other implementations, the sequencing is organized by blocks, where, for a block, the data for a certain fraction of the image is loaded to the array of display elements 150. For example, the sequence can be implemented to address every fifth row of the array of the display elements 150 in sequence.

In some implementations, the addressing process for loading image data to the array of display elements 150 is separated in time from the process of actuating the display elements. In such an implementation, the array of display elements 150 may include data memory elements for each display element, and the control matrix may include a global actuation interconnect for carrying trigger signals, from the common driver 138, to initiate simultaneous actuation of the display elements according to data stored in the memory elements.

In some implementations, the array of display elements 150 and the control matrix that controls the display elements may be arranged in configurations other than rectangular rows and columns. For example, the display elements can be arranged in hexagonal arrays or curvilinear rows and columns.

The host processor 122 generally controls the operations of the host device 120. For example, the host processor 122 may be a general or special purpose processor for controlling a portable electronic device. With respect to the display apparatus 128, included within the host device 120, the host processor 122 outputs image data as well as additional data about the host device 120. Such information may include one or more of data from environmental sensors 124, such as ambient light or temperature; information about the host device 120, including, for example, an operating mode of the host or the amount of power remaining in the host device's power source; information about the content of the image data; information about the type of image data; and instructions for the display apparatus 128 for use in selecting an imaging mode.

In some implementations, the user input module 126 enables the conveyance of personal preferences of a user to the controller 134, either directly, or via the host processor 122. In some implementations, the user input module 126 is controlled by software in which a user inputs personal preferences, for example, color, contrast, power, brightness, content, and other display settings and parameters preferences. In some other implementations, the user input module 126 is controlled by hardware in which a user inputs personal preferences. In some implementations, the user may input these preferences via voice commands, one or more buttons, switches or dials, or with touch-capability. The plurality of data inputs to the controller 134 direct the controller to provide data to the various drivers 130, 132, 138 and 148 which correspond to optimal imaging characteristics.

The environmental sensor module 124 also can be included as part of the host device 120. The environmental sensor module 124 can be capable of receiving data about the ambient environment, such as temperature and or ambient lighting conditions. The sensor module 124 can be programmed, for example, to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2B:
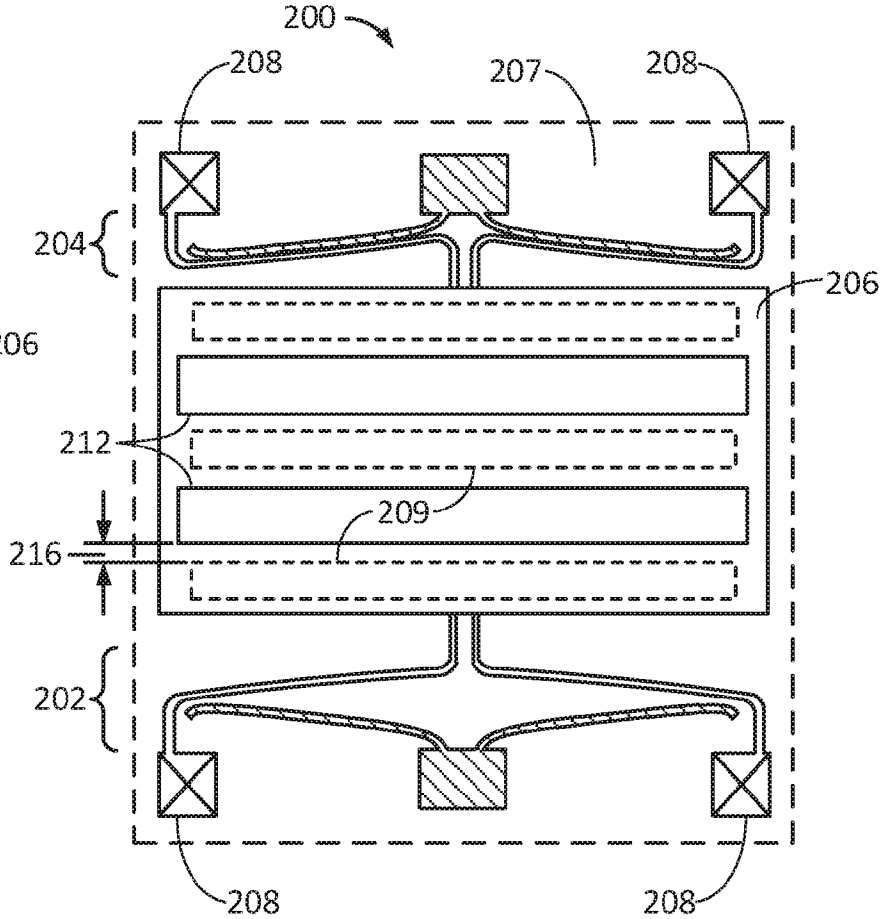
FIGS. 2A and 2B show views of an example dual actuator shutter assembly.
Figure 2A:
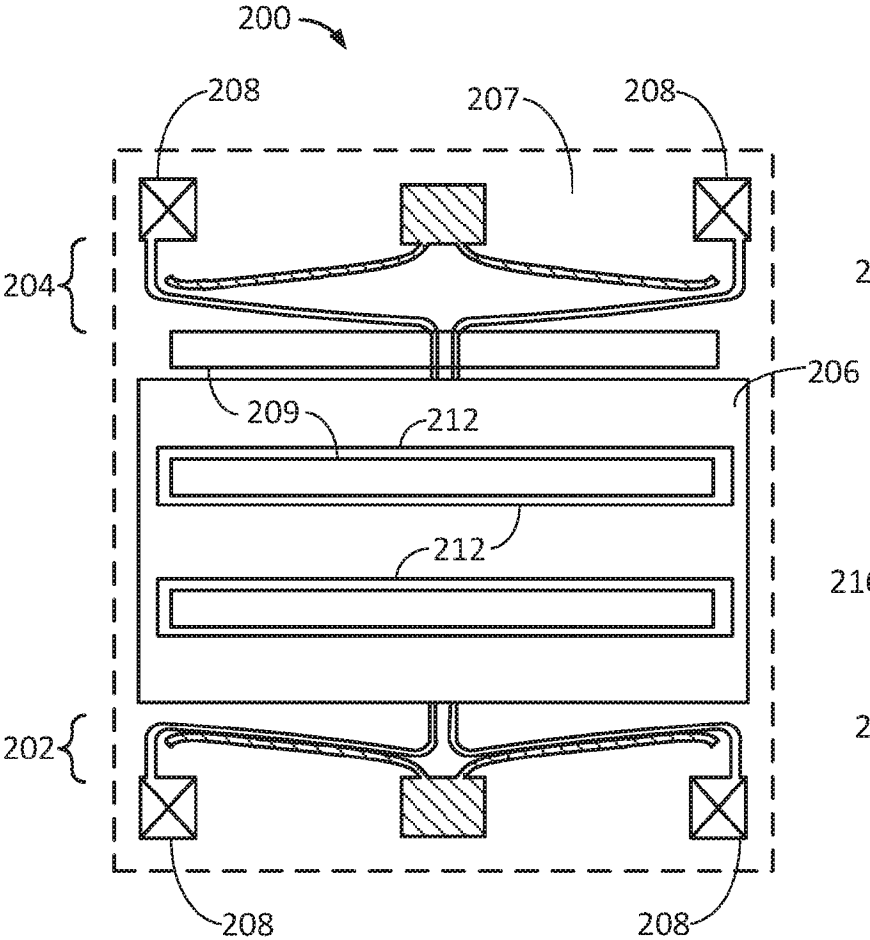

FIGS. 2A and 2B show views of an example dual actuator shutter assembly 200. The dual actuator shutter assembly 200, as depicted in FIG. 2A, is in an open state. FIG. 2B shows the dual actuator shutter assembly 200 in a closed state. The shutter assembly 200 includes actuators 202 and 204 on either side of a shutter 206. Each actuator 202 and 204 is independently controlled. A first actuator, a shutter-open actuator 202, serves to open the shutter 206. A second opposing actuator, the shutter-close actuator 204, serves to close the shutter 206. Each of the actuators 202 and 204 can be implemented as compliant beam electrode actuators. The actuators 202 and 204 open and close the shutter 206 by driving the shutter 206 substantially in a plane parallel to an aperture layer 207 over which the shutter is suspended. The shutter 206 is suspended a short distance over the aperture layer 207 by anchors 208 attached to the actuators 202 and 204. Having the actuators 202 and 204 attach to opposing ends of the shutter 206 along its axis of movement reduces out of plane motion of the shutter 206 and confines the motion substantially to a plane parallel to the substrate (not depicted).

In the depicted implementation, the shutter 206 includes two shutter apertures 212 through which light can pass. The aperture layer 207 includes a set of three apertures 209. In FIG. 2A, the shutter assembly 200 is in the open state and, as such, the shutter-open actuator 202 has been actuated, the shutter-close actuator 204 is in its relaxed position, and the centerlines of the shutter apertures 212 coincide with the centerlines of two of the aperture layer apertures 209. In FIG. 2B, the shutter assembly 200 has been moved to the closed state and, as such, the shutter-open actuator 202 is in its relaxed position, the shutter-close actuator 204 has been actuated, and the light blocking portions of the shutter 206 are now in position to block transmission of light through the apertures 209 (depicted as dotted lines).

Each aperture has at least one edge around its periphery. For example, the rectangular apertures 209 have four edges. In some implementations, in which circular, elliptical, oval, or other curved apertures are formed in the aperture layer 207, each aperture may have a single edge. In some other implementations, the apertures need not be separated or disjointed in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through the apertures 212 and 209 in the open state, the width or size of the shutter apertures 212 can be designed to be larger than a corresponding width or size of apertures 209 in the aperture layer 207. In order to effectively block light from escaping in the closed state, the light blocking portions of the shutter 206 can be designed to overlap the edges of the apertures 209. FIG. 2B shows an overlap 216, which in some implementations can be predefined, between the edge of light blocking portions in the shutter 206 and one edge of the aperture 209 formed in the aperture layer 207.

The electrostatic actuators 202 and 204 are designed so that their voltage-displacement behavior provides a bi-stable characteristic to the shutter assembly 200. For each of the shutter-open and shutter-close actuators, there exists a range of voltages below the actuation voltage, which if applied while that actuator is in the closed state (with the shutter being either open or closed), will hold the actuator closed and the shutter in position, even after a drive voltage is applied to the opposing actuator. The minimum voltage needed to maintain a shutter's position against such an opposing force is referred to as a maintenance voltage $V_m$.

Generally, electrical bi-stability in electrostatic actuators, such as actuators 202 and 204, arises from the fact that the electrostatic force across an actuator is a strong function of position as well as voltage. The beams of the actuators in the light modulator 200 can be implemented to act as capacitor plates. The force between capacitor plates is proportional to $1/d^2$ where d is the local separation distance between capacitor plates. When the actuator is in a closed state, the local separation between the actuator beams is very small. Thus, the application of a small voltage can result in a relatively strong force between the actuator beams of the actuator in the closed state. As a result, a relatively small voltage, such as $V_m$, can keep the actuator in the closed state, even if other elements exert an opposing force on the actuator.

In dual-actuator light modulators, such as 200 the equilibrium position of the light modulator will be determined by the combined effect of the voltage differences across each of the actuators. In other words, the electrical potentials of the three terminals, namely, the shutter open drive beam, the shutter close drive beam, and the load beams, as well as modulator position, are considered to determine the equilibrium forces on the modulator.

For an electrically bi-stable system, a set of logic rules can describe the stable states and can be used to develop reliable addressing or digital control schemes for a given light modulator. Referring to the shutter-based light modulator 200 as an example, these logic rules are as follows:

Let $V_s$ be the electrical potential on the shutter or load beam. Let $V_o$ be the electrical potential on the shutter-open drive beam. Let $V_c$ be the electrical potential on the shutter-close drive beam. Let the expression $|V_o-V_s|$ refer to the absolute value of the voltage difference between the shutter and the shutter-open drive beam. Let $V_m$ be the maintenance voltage. Let $V_{at}$ be the actuation threshold voltage, i.e., the voltage to actuate an actuator absent the application of $V_m$ to an opposing drive beam. Let $V_{max}$ be the maximum allowable potential for $V_o$ and $V_c$. Let $V_m<V_m<V_{max}$. Then, assuming $V_o$ and $V_c$ remain below $V_{max}$:

$$\text{If } |V_o-V_s|<V_m \text{ and } |V_c-V_s|<V_m \quad \text{(rule 1)}$$

Then the shutter will relax to the equilibrium position of its mechanical spring.

$$\text{If } |V_o-V_s|>V_m \text{ and } |V_c-V_s|>V_m \quad \text{(rule 2)}$$

Then the shutter will not move, i.e., it will hold in either the open or the closed state, whichever position was established by the last actuation event.

$$\text{If } |V_o-V_s|>V_{at} \text{ and } |V_c-V_s|<V_m \quad \text{(rule 3)}$$

Then the shutter will move into the open position.

$$\text{If } |V_o-V_s|<V_m \text{ and } |V_c-V_s|>V_{at} \quad \text{(rule 4)}$$

Then the shutter will move into the closed position.

Following rule 1, with voltage differences on each actuator near zero, the shutter will relax. In many shutter assemblies, the mechanically relaxed position is partially open or closed, and so this voltage condition is usually avoided in an addressing scheme.

The condition of rule 2 makes it possible to include a global actuation function into an addressing scheme. By maintaining a shutter voltage which provides beam voltage differences that are at least the maintenance voltage, $V_m$, the absolute values of the shutter open and shutter closed potentials can be altered or switched in the midst of an addressing sequence over wide voltage ranges (even where voltage differences exceed $V_{at}$) with no danger of unintentional shutter motion.

The conditions of rules 3 and 4 are those that are generally targeted during the addressing sequence to ensure the bi-stable actuation of the shutter.

The maintenance voltage difference, $V_m$, can be designed or expressed as a certain fraction of the actuation threshold voltage, $V_{at}$. For systems designed for a useful degree of bi-stability, the maintenance voltage can exist in a range between about 20% and about 80% of $V_{at}$. This helps ensure that charge leakage or parasitic voltage fluctuations in the system do not result in a deviation of a set holding voltage out of its maintenance range—a deviation which could result in the unintentional actuation of a shutter. In some systems an exceptional degree of bi-stability or hysteresis can be provided, with $V_m$ existing over a range of about 2% and about 98% of $V_{at}$. In these systems, however, care must be taken to ensure that an electrode voltage condition of $|V_c-V_s|$ or $|V_o-V_s|$ being less than $V_m$ can be reliably obtained within the addressing and actuation time available.

Figure 3:
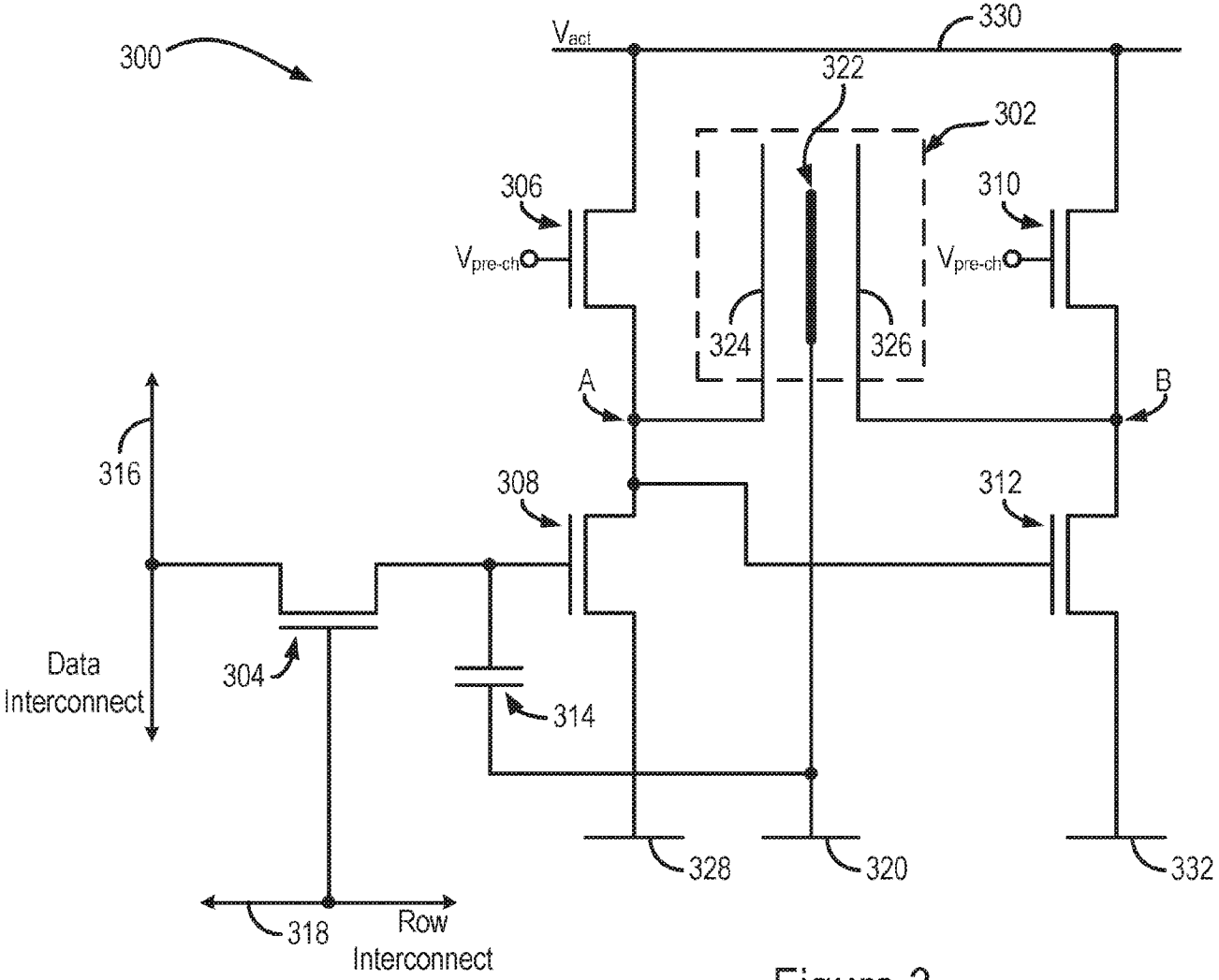
FIG. 3 shows a schematic of an example pixel circuit for controlling a light modulator.

FIG. 3 shows a schematic of an example pixel circuit 300 for controlling a light modulator 302. In particular, the pixel circuit 300 can be used for controlling dual actuator light modulators, such as the light modulator 200 shown in FIGS. 2A and 2B. In some implementations, the pixel circuit 300 can be part of a control matrix used for controlling an array of light modulators 302, such as, for example, the array of display elements 150 shown in FIG. 1B.

The pixel circuit 300 includes a data transistor 304, a first charge transistor 306, a first discharge transistor 308, a second charge transistor 310, a second discharge transistor 312 and a data capacitor 314. In some implementations, various components of the pixel circuit 300 can be implemented using thin film transistors (TFTs). In some implementations, the TFTs can be manufactured using materials such as amorphous-silicon (a-Si), indium-gallium-zinc-oxide (IGZO), or polycrystalline-silicon (poly-Si). In some other implementations, various components of the pixel circuit 300 can be implemented using MOSFETs. As will be readily understood by a person having ordinary skill in the art, TFTs are three terminal transistors having a gate terminal, source terminal, and a drain terminal. The gate terminal can act as a control terminal such that a voltage applied to the gate terminal in relation to the source terminal can switch the TFT ON or OFF. In the ON state, the TFT allows electrical current flow between the source terminal and the drain terminal. In the OFF state, the TFT substantially blocks any current flow between the source and the drain. The implementation of the pixel circuit 300, however, is not limited to TFTs or MOSFETS, and other transistors such as bipolar junction transistors (BJTs) also may be utilized.

As mentioned above, the light modulator 302 can be a dual actuator light modulator, and can include, a shutter 322, a shutter-open actuator 324 and a shutter-close actuator 326. Each of the shutter-open actuator 324 and the shutter-close actuator 326 can include two electrodes: a drive beam electrode and a load beam electrode. For example, the shutter-open actuator 324 and the shutter-close actuator 326 can be similar to the shutter open actuator 204 and shutter close actuator 204 shown in FIGS. 2A and 2B. As such, the load beam electrode of each of the shutter-open actuator 324 and the shutter-close actuator 326 can be attached to the shutter 322, and can receive voltage from a common interconnect 320. The drive beam electrodes of the shutter-open actuator 324 and the shutter-close actuator 326 can each be connected to the pixel circuit 300 at Node A and Node B, respectively. As referred to hereinafter, unless explicitly stated otherwise, reference to voltages applied or provided to the shutter-open actuator 324 and the shutter-close actuator 326 specifically refers to the voltages applied or provided to the drive beam electrodes of the respective actuators.

A first source/drain terminal of the data transistor 304 can be coupled to a data interconnect 316, which can provide a data voltage representative of image data, while the second source/drain terminal of the data transistor 304 can be coupled to the gate terminal of the first discharge transistor 308 and to a first terminal of the data capacitor 314. The data interconnect can be coupled to a data driver, such as one of the plurality of data drivers 132 shown in FIG. 1B. The gate terminal of the data transistor 304 can be coupled to a row interconnect 318, which can provide a row enable signal. The row interconnect 318 can be coupled to a scan driver, such as one of the plurality of scan drivers 130 shown in FIG. 1B. A second terminal of the data capacitor 314 can be coupled to the common interconnect 320, which can provide a common or ground voltage. The common interconnect 320 can be connected to a common driver, such as the common driver 138 shown in FIG. 1B. When a write enabling voltage is provided to the gate of the data transistor 304 over the row interconnect 318, the data transistor 304 can switch ON and load the data capacitor 314 with the data voltage provided on the data interconnect 316.

The second source/drain terminal of the data transistor 304 and the first terminal of the data capacitor 314 are coupled to the gate terminal of the first discharge transistor 308. The drain terminal of the first discharge transistor 308 is coupled to Node A, to which the source terminal of the first charge transistor 306 and the shutter-open actuator 324 are coupled. The source terminal of the first discharge transistor 308 is coupled to a first update interconnect 328, which provides a first update voltage. The drain terminal of the first charge transistor 306 is coupled to an actuation voltage interconnect 330, which can provide an actuation voltage $V_{act}$, and the gate terminal of the first charge transistor 306 is provided with a pre-charge signal $V_{pre\text{-}ch}$.

The gate terminal of the second charge transistor 310 also is provided with the same pre-charge signal provided to the gate terminal of the first charge transistor 306. The drain terminal and the source terminal of the second charge transistor 310 are coupled to the actuation voltage interconnect 330 and Node B, respectively. Node B also is coupled to the shutter-close actuator 326 and the drain terminal of the second discharge transistor 312. The source terminal of the second discharge transistor 312 is coupled to a second update interconnect 332.

The pixel circuit 300 operates in at least three phases: a data load phase, a pre-charge phase, and an update phase. During the data load phase, the first update voltage applied to the first update interconnect 328 is maintained at a high voltage, such as, for example, substantially equal to the high data voltage. As a result, the first discharge transistor 308 remains in the OFF state regardless of the applied data voltage, and the data voltage stored on the data capacitor 314 can be changed without affecting the state of the light modulator 302. In the data load phase, the data voltage to be loaded into the pixel circuit 300 is provided on the data interconnect 316. The row enable signal is provided on the row interconnect 318, such that the data transistor 304 switches ON, causing the data capacitor 314 to be charged substantially to the data voltage provided on the data interconnect 316.

During the pre-charge phase, the first update voltage provided on the first update interconnect 328 remains at the same high voltage applied during the load phase and the first discharge transistor 308 remains in the OFF state. The second update voltage provided on the second update interconnect 332 is switched to a high voltage substantially equal to the actuate voltage applied to the actuation voltage interconnect 330 such that the second discharge transistor 312 is also maintained in the OFF state. During the pre-charge phase, the pre-charge signal provided to the gate terminals of the first charge transistor 306 and the second charge transistor 310 goes high, such that the first charge transistor 306 and the second charge transistor 310 switch ON. As a result, current flows from the actuation voltage interconnect 330, which is maintained at a substantially constant actuation voltage, to Node A and Node B. As the first discharge transistor 308 and the second discharge transistor 312 are switched OFF, Node A and Node B are charged to a voltage that is substantially equal to the actuation voltage, at which point substantially no additional current is drawn from the actuation voltage interconnect 330. Therefore the shutter-open actuator 324 and the shutter-close actuator 326, which are connected to Node A and Node B, respectively, receive substantially the same actuation voltage. If the common interconnect 320 is at a low voltage, such as for example, about 0 V, then the shutter 322 will remain in its current position. If however, the common interconnect 320 is at a high voltage, such as, for example, about the actuation voltage, then the shutter 322 will move to a position between its open and closed positions. Once Node A and Node B have been charged, the pre-charge signal goes low, such that the first charge transistor 306 and the second charge transistor 310 are switched OFF.

During the update phase, the first update voltage on the first update interconnect 328 is lowered such that the first discharge transistor 308 can respond to the data voltage stored on the data capacitor 314. The low value of the first update voltage can be chosen such that, if the data voltage stored on the data capacitor 314 is high, then the first discharge transistor 308 switches ON, but if the data voltage stored on the data capacitor 314 is low, then the first discharge transistor 308 remains OFF. Thus, if the data voltage is high then current will flow from Node A to the first update interconnect 328, discharging Node A until its voltage is close to the low update voltage, but if the data voltage is low then Node A will remain charged and close to the actuation voltage. Appropriately selecting the low update voltage applied to the first update interconnect 328 can ensure correct operation of the pixel circuit 300. In some implementations, the appropriate value for the low update voltage can depend on a number of factors including (but not limited to) the threshold voltage and transconductance of the first discharge transistor 308 and the difference between the high and low data voltages.

The update phase is completed by lowering the second update interconnect 332 to approximately 0 V after enough time has been allowed for Node A to discharge to its low voltage if the data voltage is high. If Node A has remained high, then the second discharge transistor 312 will turn ON and discharge Node B, but if Node A has been discharged then the second discharge transistor 312 remains in the OFF state, and Node B is maintained at about the actuation voltage. Finally, the first update voltage on the first update interconnect 328 is raised to a high level such that the first discharge transistor 308 switches OFF or remains switched OFF regardless of the data voltage. This pixel circuit 300 is then in an appropriate state for the next data load phase.

In some implementations, when the first update interconnect 328 is raised from the low first update voltage to the high first update voltage, and the data voltage is high, the first discharge transistor 308 is in the ON state. As a result, the voltage on Node A may also increase with the increase in the voltage on the first update interconnect 328. This may result in the second discharge transistor 312 switching ON and undesirably discharging Node B. To reduce the risk of the second discharge transistor 312 from switching ON due to the increase in the first update voltage on the first update interconnect 328, in some implementations, the low second update voltage applied to the second update interconnect 332 is appropriately selected. In some implementations, the second update voltage on the second update interconnect 332 can be increased prior to the increase in the first update voltage on the first update interconnect 328. In some such implementations, the second update interconnect 332 is increased to a voltage level that lies between the low second update voltage and the high second update voltage.

As mentioned above, if the data voltage is high, then the voltage on Node A is reduced to about 0 V. As a result, the second discharge transistor 312 will remain switched OFF, maintaining the voltage on Node B. As the shutter-close actuator 326 is maintained at about the actuation voltage and the shutter-open actuator 324 is maintained at about 0 V, the shutter 322 is pulled towards the shutter-close actuator 326, resulting in a CLOSED light modulator 302 state if the common interconnect 320 is at a low voltage of about 0 V. If, however, the common interconnect 320 is at a high voltage (i.e., at about the actuation voltage) then the shutter 322 is pulled towards the shutter-open actuator, resulting in an OPEN light modulator 302. Also as mentioned above, if the data voltage is low, the voltage on Node A is maintained at about the actuation voltage. Therefore, when the second update voltage goes low, the second discharge transistor 312 switches ON, resulting in the voltage on Node B and the shutter-close actuator 326 to be pulled down to about 0 V. As the shutter-open actuator 324 is maintained at the actuation voltage and the shutter-close actuator 326 is maintained at 0 V, the shutter 322, assuming the common interconnect 320 is at a low voltage of about 0 V, is pulled towards the shutter-open actuator 324, resulting in an OPEN light modulator 302 state. If, however, the common interconnect 320 is at a high voltage of about the actuation voltage, then the shutter 322 is pulled towards the shutter-close actuator 326, resulting in a CLOSED light modulator 302. In this manner, the state of the light modulator 302 is controlled based on the data voltage stored in the data capacitor. The data load phase, the pre-charge phase, and the update phase can be repeated to load data corresponding to another image frame or image sub-frame.

Figure 4A:
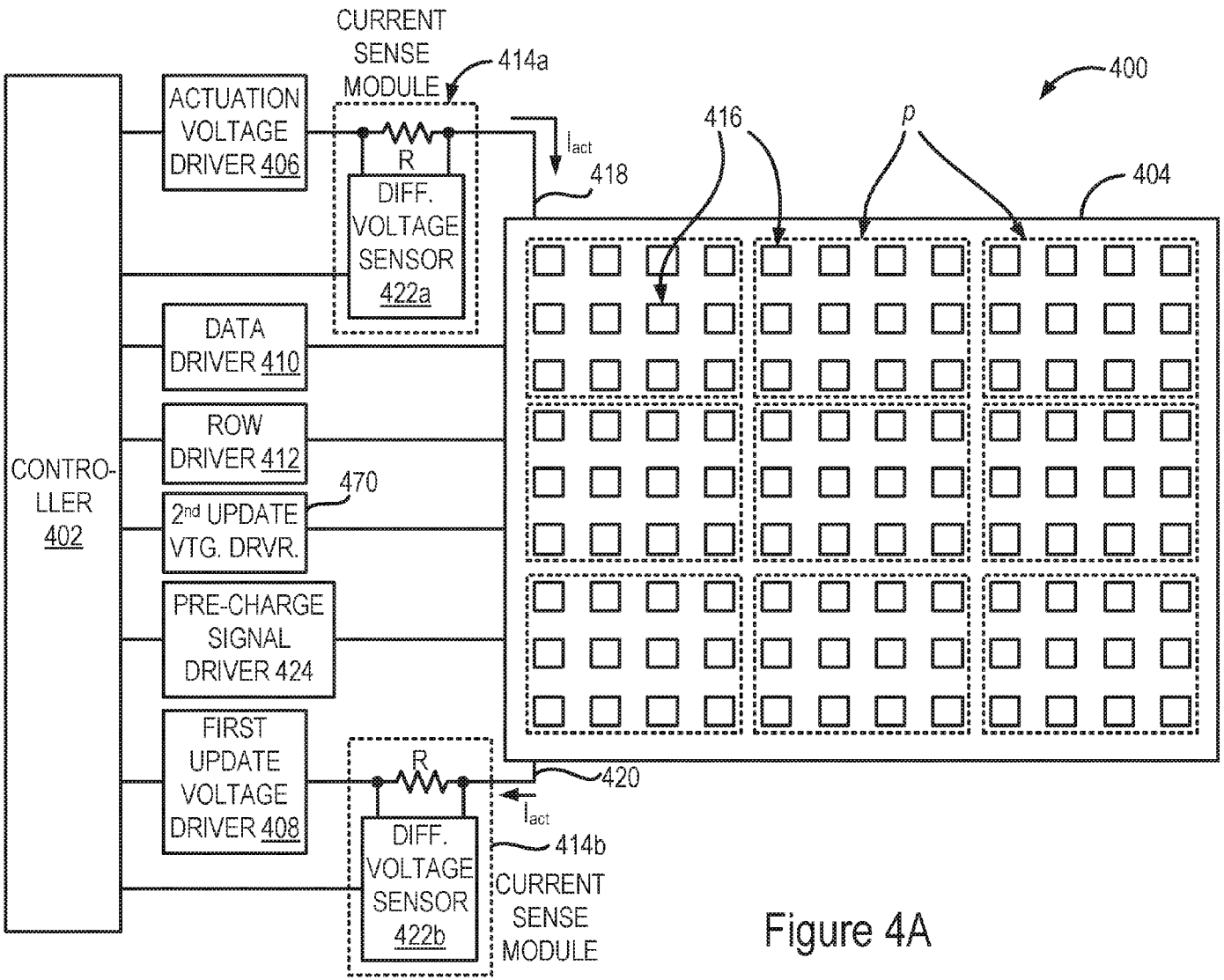
FIG. 4A shows a block diagram of an example display apparatus that can be used for tuning the pixel circuit shown in FIG. 3.

FIG. 4A shows a block diagram of an example display apparatus 400 that can be used for tuning the pixel circuit 300 shown in FIG. 3. In particular, FIG. 4A depicts one approach to tuning the pixel circuit 300 in which the voltage output by the update voltage source is varied to test the pixel circuit 300. The display apparatus 400 includes a controller 402, an array of display elements 404, an actuation voltage driver 406, a first update voltage driver 408, a second update voltage driver 470, a data driver 410, a row driver 412, a pre-charge signal driver 424, a first current sense module 414*a* or a second current sense module 414*b*. Two possible locations for the current sense module, 414*a* and 414*b*, are shown for completeness; in some implementations, only one current sense module may be required. The display apparatus 400 can be similar to the display apparatus 120 shown in FIG. 1B, in that the controller 402, the array of display elements 404, the data driver 410, and the row driver 412 can be similar to the controller 134, the array of display elements 150, the data drivers 132, and the scan drivers 130 discussed above in relation to FIG. 1B. Further, the actuation voltage driver 406, the pre-charge signal driver 424, and the first update voltage driver 408 can be similar to the common driver 138 discussed above in relation to FIG. 1B. In some implementations, while not explicitly shown in FIG. 4A, the display apparatus 400 can include additional components such as lamp drivers, lamps of various colors, a host processor, environmental sensors, and a user input module.

The array of display elements 404 can include a plurality of pixel circuits 416. In some implementations, each of the plurality of pixel circuits 416 can be implemented using the pixel circuit 300 shown in FIG. 3. As mentioned above, the pixel circuit 300 can include an actuation voltage interconnect 330. The actuation voltage interconnect in each of the pixel circuits 416 can be connected to a display actuation voltage interconnect 418. Similarly, a first update voltage interconnect (similar to the first update interconnect 328 shown in FIG. 3) in each of the pixel circuits 416 can be connected to a display first update voltage interconnect 420. The display actuation voltage interconnect 418 can be coupled to the actuation voltage driver 406 via the current sense module 414*a*, and the display first update voltage interconnect 420 can be coupled to the first update voltage driver 408. The pre-charge signal driver 424 can be connected to a display pre-charge interconnect (not shown), which in turn can be connected to the gate terminals of the first charge transistor and the second charge transistors (such as the first charge transistor 306 and the second charge transistor 310 shown in FIG. 3) of each of the pixel circuits 416.

The first current sense module 414*a* or the second current sense module 414*b* can be used to sense the magnitude of a current $I_{act}$ supplied by the actuation voltage driver 406 to the plurality of pixel circuits 416. In some implementations, the current sense module 414*a* can include a resistor R and a differential voltage sensor 422. The resistor R can be connected between the output of the actuation voltage driver 406 and the display actuation voltage interconnect 418. The current $I_{act}$, which flows through the resistor R, causes a voltage drop across the resistor R. The voltage drop across the resistor R is sensed by the differential voltage sensor 422 and provided to the controller 402 as a voltage that is representative of the magnitude of the actuation current $I_{act}$. In some implementations, the current sense module 414*a* may include an analog-to-digital converter (ADC) to convert the analog voltage output by the differential voltage sensor 422 into a digital value, which can be provided to the controller 402. The second current sense module 414*b* can be positioned between the first update voltage driver 408 and the display first update voltage interconnect 420 to sense the current entering the first update voltage driver 408. The second current sense module 414*b* also can include a resistor R and a differential voltage sensor 422*b*, which is similar to the differential voltage sensor 422*a*.

Figure 4B:
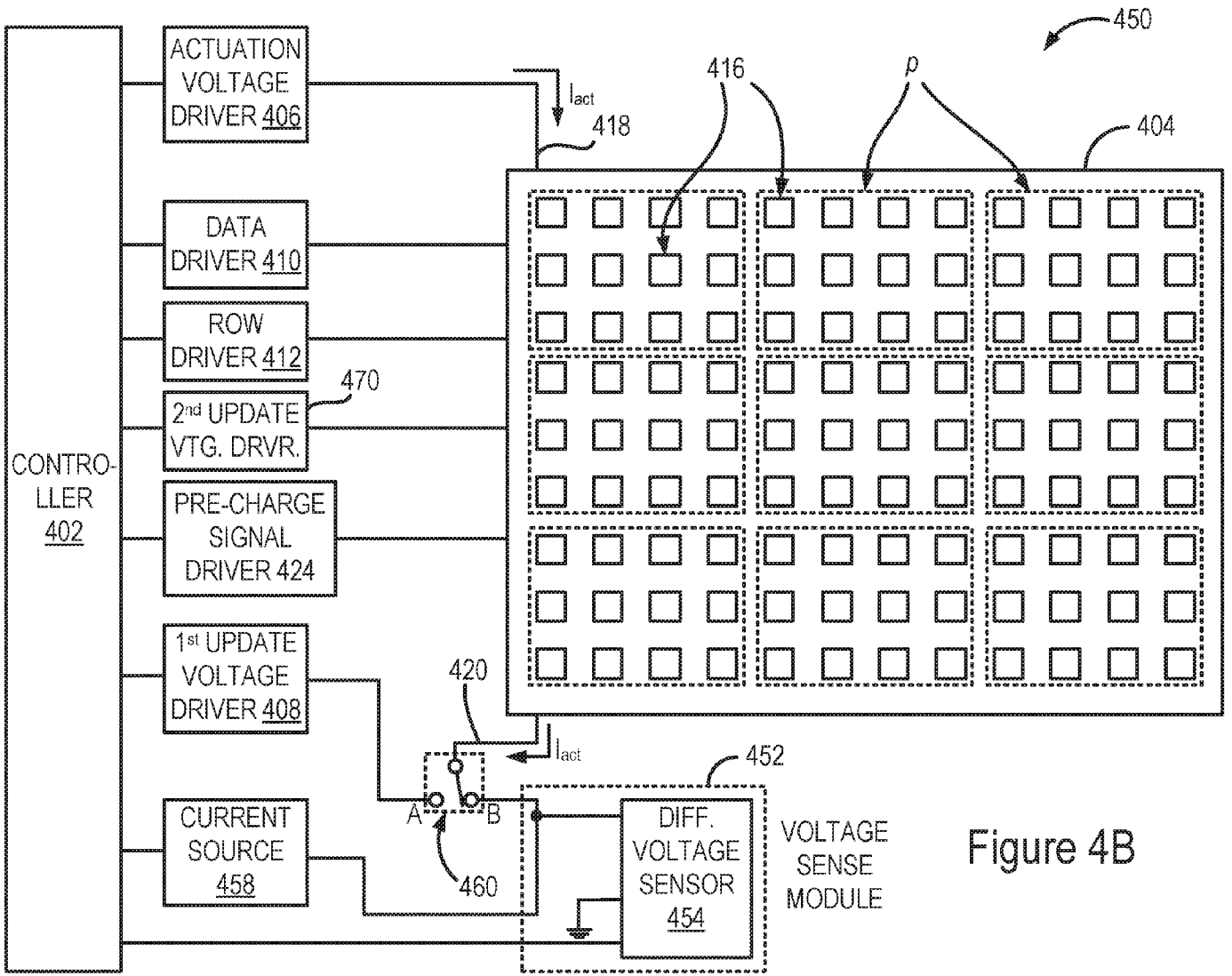
FIG. 4B shows a block diagram of another example display apparatus that can be used for tuning the pixel circuit shown in FIG. 3.

FIG. 4B shows a block diagram of another example display apparatus 450 that can be used for tuning the pixel circuit 300 shown in FIG. 3. Unlike the display apparatus 400, shown in FIG. 4A, in which the pixel circuit 300 is tested by varying the first update voltage, the display apparatus 450 instead utilizes a current source 458 for testing the pixel circuit 300. In addition to the current source 458, the display apparatus 450 includes a voltage sense module 452 and a switch 460. The switch 460 allows the display apparatus 450 to switch between testing and normal operation modes. For example, during normal operations, the controller 402 can control the switch 460 into position A. In position A, the switch 460 connects the display panel 404 to the first update voltage driver 408. To switch to the testing mode, the controller 402 controls the switch 460 into position B, in which the display panel 404 is disconnected from the first update voltage driver 408 and is instead connected to the current source 458. The current source 458 can be controlled by the controller 402 to draw a test current for testing the display panel 404. In some implementations, the current source 458 can be a voltage controlled current source the current value of which can be controlled with a corresponding control voltage value. The voltage sense module 452 measures the voltage at the display first update voltage interconnect 420, which is connected to the source terminals of the first discharge transistor 308 of each of the pixel circuits 416. The voltage sense module includes a differential voltage sensor 454, which can be similar to the differential voltage sensors 422*a* and 422*b* shown in FIG. 4A. However, unlike the differential voltage sensors 422*a* and 422*b*, which operate in the differential mode, the differential voltage sensor 454, by virtue of one of its two inputs being connected to ground, operates in a single-ended mode.

In some implementations, the controller 402 can control both the timing and the magnitude of the voltages output by each of the drivers of the display apparatus 400. For example, the controller 402 can control the magnitude and the timing of the first update voltage output by the first update voltage driver 408. In some other implementations, the controller 402 can control the magnitude and the timings of the voltages output by the various drivers to operate each of the plurality of pixel circuits 416 in a manner discussed above in relation to FIG. 3.

In some implementations the controller 402 can control the magnitude and the timing of the voltages output by various drivers within the display apparatus 400 to test the voltage responses of one or more transistors within the pixel circuits 416, as discussed below.

Figure 5A:
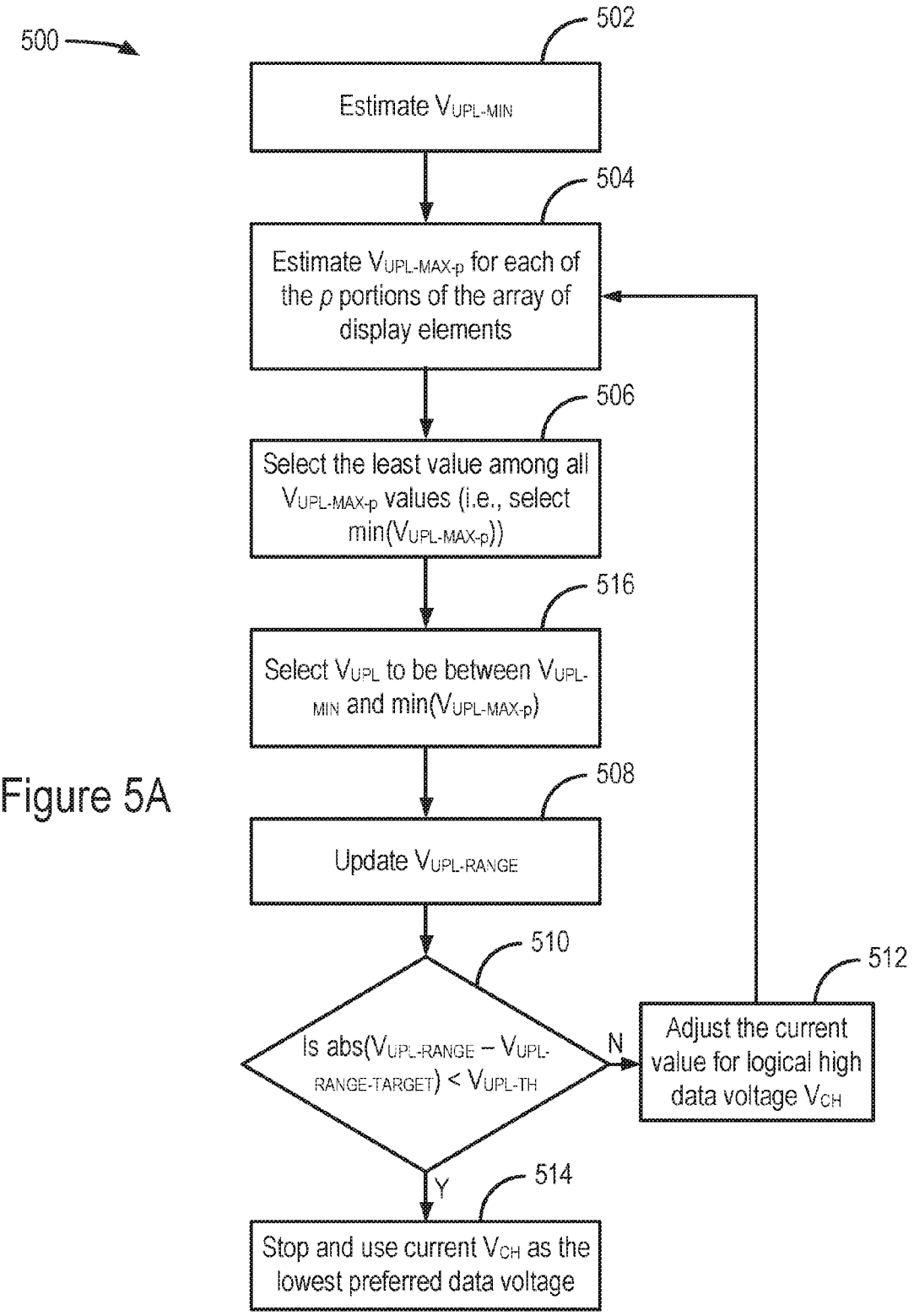
FIG. 5A shows an example flow diagram of a process for tuning the display update and data drive voltages by testing voltage responses of transistors within display elements shown in FIGS. 4A and 4B.

FIG. 5A shows an example flow diagram of a process 500 for tuning the display update and data drive voltages by testing voltage responses of transistors within the display elements shown in FIGS. 4A and 4B. In particular, the process 500 can be executed by a controller of a display apparatus, such as the controller 402 of the display apparatus 400 shown in FIGS. 4A and 4B. In some implementations, the process 500 can by executed by the controller to determine appropriate values for the low first update voltage and for the logical high data voltage that can be loaded into the data capacitor of the pixel circuit. In particular, the process 500 can be executed by the controller 402 to determine the lowest preferred value for the logical high data voltage ($V_{CH}$) for which the display apparatus can operate reliably.

In particular, the process 500 includes estimating a minimum low first update voltage $V_{UPL-MIN}$ (stage 502), estimating a maximum low first update voltage $V_{UPL-MAX-p}$ for each of p portions of the array of display elements (stage 504), selecting the least value among all $V_{UPL-MAX-p}$ values (stage 506), selecting a value for the low first update voltage between the estimated value of $V_{UPL-MIN}$ and the least value among all $V_{UPL-MAX-p}$ (stage 516), updating the value of a low first update voltage range $V_{UPL-RANGE}$ (stage 508), determining whether the absolute difference between the low first update voltage range $V_{UPL_RANGE}$ and a target range $V_{UPL-RANGE-TARGET}$ is less than a convergence threshold voltage ($V_{UPL-TH}$) (stage 510), adjusting the current value for logical high data voltage $V_{CH}$ if the absolute difference is not less than $V_{UPL-TH}$ (stage 512), and using the current value of the logical high data voltage $V_{CH}$ as the lowest preferred logical high data voltage if the absolute difference is less than $V_{UPL-TH}$ (stage 514).

Figure 5B:
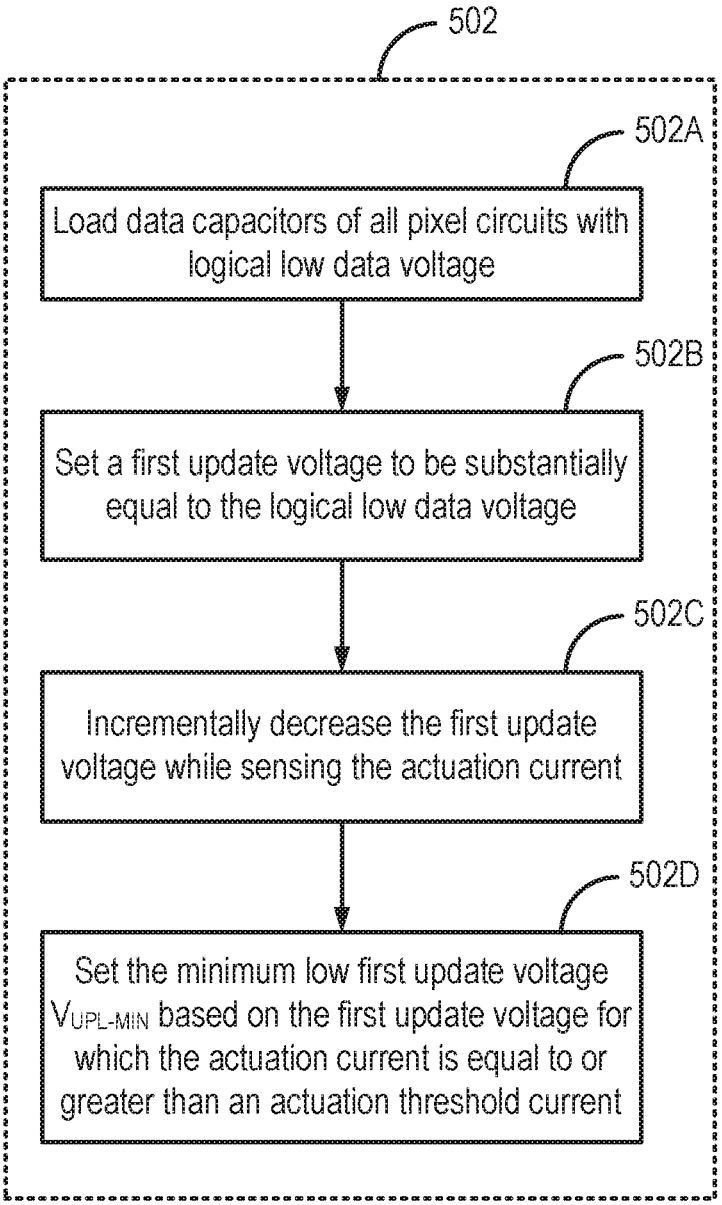
FIG. 5B-5E show additional details of the process shown in FIG. 5A.
Figure 5C:
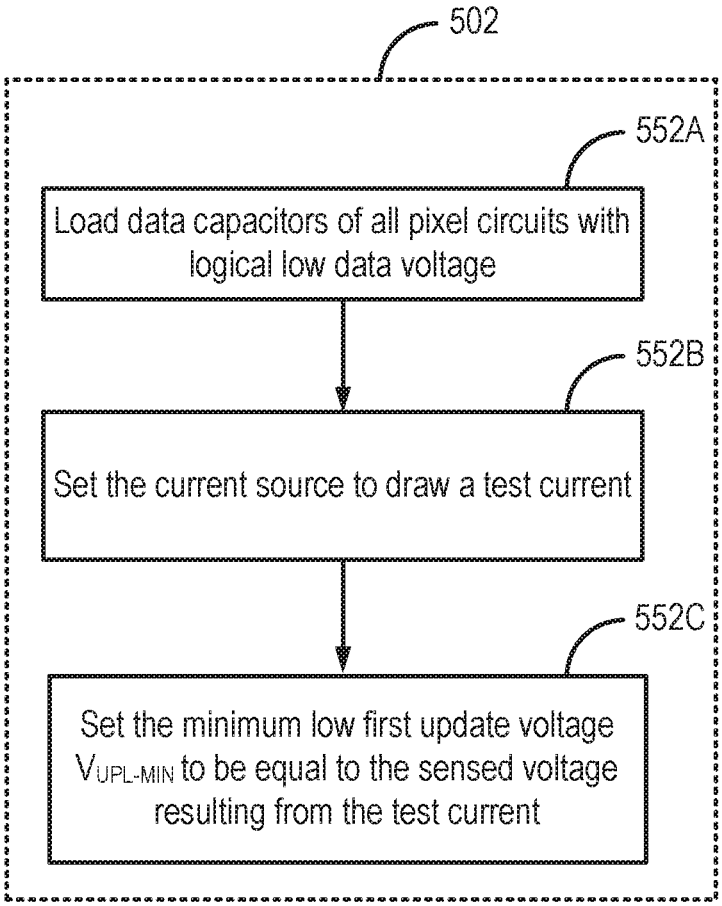
Figure 5D:
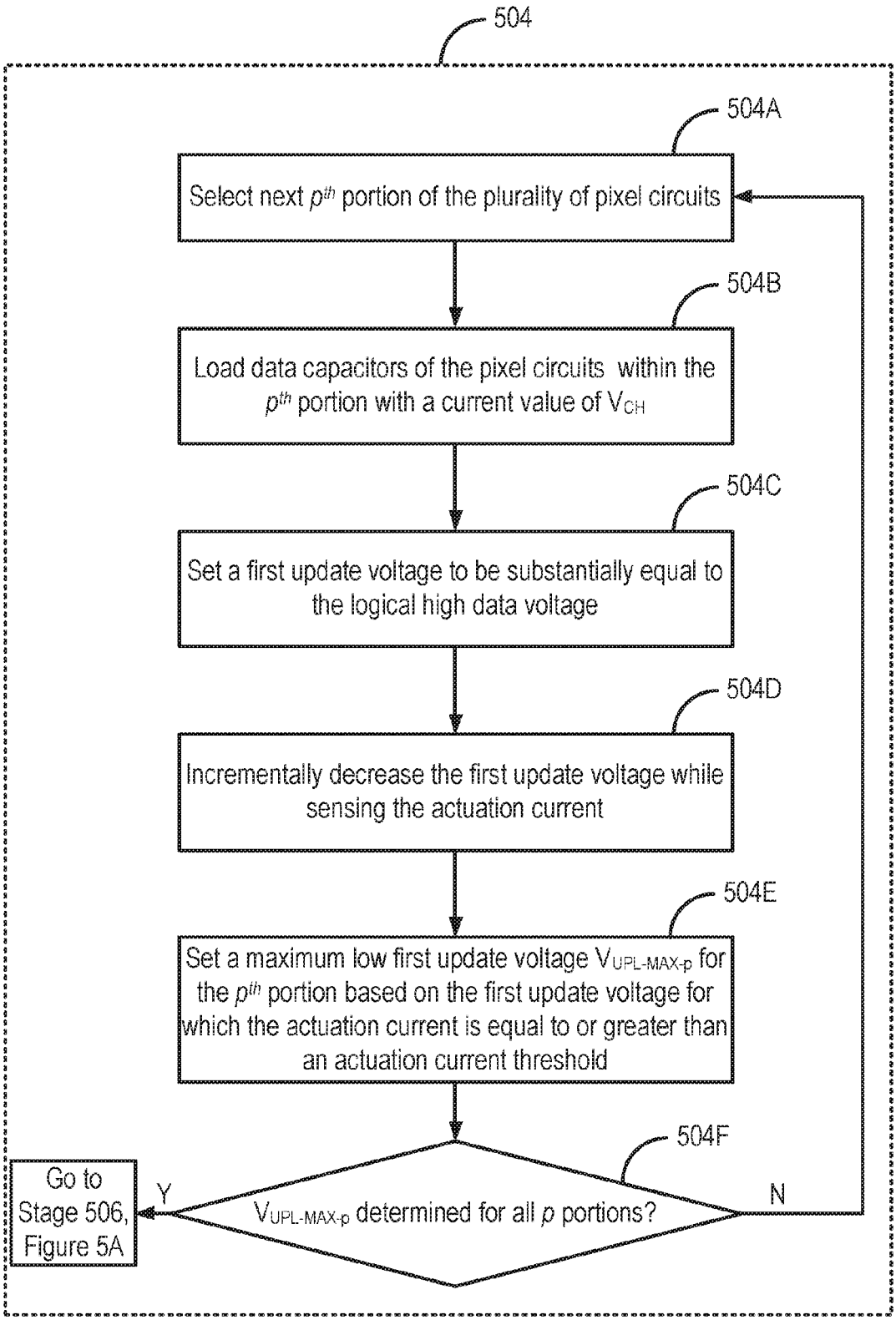
Figure 5E:
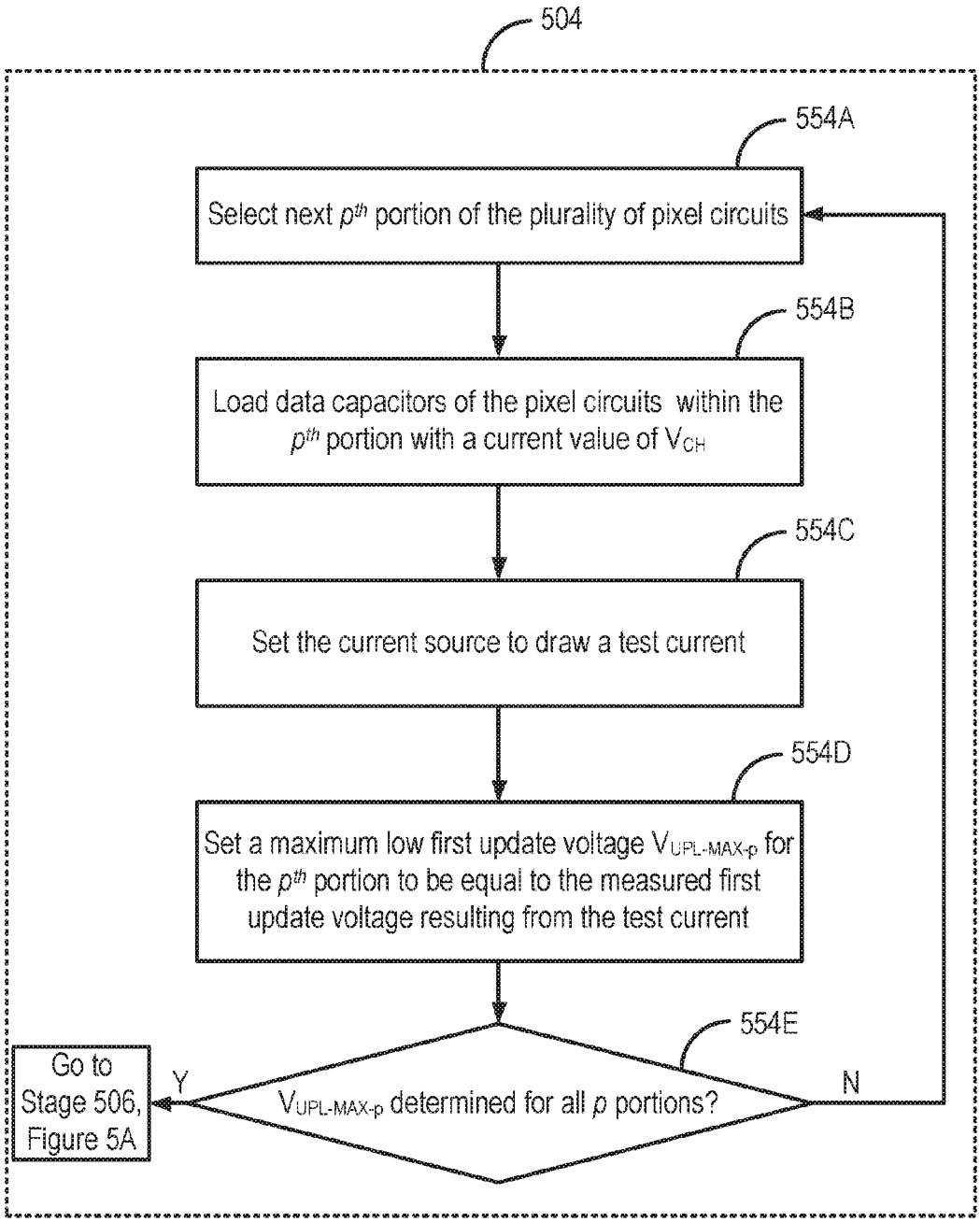

FIGS. 5B-5E show additional details of the process 500 shown in FIG. 5A. In particular, FIGS. 5B and 5D show additional details of the stages 502 and 504, respectively, of the process 500 when testing the display apparatus 400 shown in FIG. 4A. FIGS. 5C and 5E show additional details of the stages 502 and 504, respectively, of the process 500 when testing the display apparatus 450 shown in FIG. 4B.

The process 500 includes determining a minimum low first update voltage $V_{UPL-MIN}$ (stage 502). As shown in FIG. 5B, determining a minimum low first update voltage $V_{UPL-MIN}$ (stage 502) includes loading the data capacitors of all of the pixel circuits with a logical low data voltage (stage 502A). For example, referring to FIGS. 3 and 4A, the controller 402 can control the data drivers 410 and the row drivers 412 to load about 0 V into the data capacitor 314 of each of the pixel circuits 416 of the display apparatus 400.

The stage 502 further includes setting the first update voltage to be substantially equal to the logical low data voltage stored in the data capacitors of the pixel circuits (stage 502B). For example, the controller 402 can control the first update voltage driver 408 to output a voltage that is substantially equal to the logical low data voltage (such as 0 V) loaded in the data capacitor 314. This results in both the gate terminal and the source terminal of the first discharge transistor 308 to be at 0 V, which, in turn, results in the first discharge transistor 308 to remain in the OFF state. Once the update voltage is set to be substantially equal to the logical low data voltage, the controller 402 can control the pre-charge signal driver 424 to output a logical high pre-charge signal such that the first and second charge transistors 306 and 310 are switched ON. This results in a potential current path for the actuation current $I_{act}$ through the first charge transistor 306.

At the same time, the second update interconnect 332 is set to the actuation voltage. This prevents the possibility of any current flow though a path including the second charge transistor 310 and the second discharge transistor 312.

In some cases, the first discharge transistor 308 might have a negative threshold voltage and current will pass through transistor 308 even when both gate and source are at the same voltage. In such cases, the starting value for the first update voltage can be set to a voltage higher than the logical low data voltage, to ensure that the first discharge transistor 308 starts in the OFF or low-current state.

Determining the minimum low first update voltage $V_{UPL-MIN}$ (stage 502) further includes incrementally decreasing the first update voltage while sensing the actuation current (stage 502C). For example, the controller 402 can control the first update voltage driver 408 to incrementally reduce the first update voltage provided to the first update interconnect 328 from an initial value of 0 V. In some implementations, the controller 402 can reduce the first update voltage output by the first update voltage driver 408 in increments (such as increments of about 100 mV). Referring again to FIG. 3, as the voltage on the first update interconnect 328 decreases, the voltage difference between the gate terminal and the source terminal of the first discharge transistor 308 increases. With further decreases in the first update voltage, the voltage difference between the gate and the source terminals of the first discharge transistor 308 may become equal to or greater than the threshold voltage of the first discharge transistor 308. This can result in the first discharge transistor 308 switching ON. As the first charge transistor 306 is also maintained in the ON state, the switching ON of the first discharge transistor 308 results in a current path between the actuation voltage interconnect 330 and the first update interconnect 328.

In some implementations, the first discharge transistors 308 in different pixel circuits 416 within the plurality of display elements 404 can have different threshold voltages. This difference in the threshold voltages can be due to various factors such as variations in manufacturing process, temperature, and ambient light conditions. Thus, as the first update voltage is reduced by the controller 402, some of the first discharge transistors 308 in some pixel circuits 416 may switch ON before others. Nevertheless, with a step-by-step decrease in the first update voltage, first discharge transistors 308 in an increasing number of pixel circuits 416 would switch ON, resulting in an increase in the magnitude of the actuation current $I_{act}$. The controller 402 also can monitor the magnitude of the actuation current $I_{act}$ with each change in the first update voltage via the first current sense module 414*a*.

Determining the minimum low first update voltage $V_{UPL-MIN}$ (stage 502) further includes setting the minimum low first update voltage $V_{UPL-MIN}$ based on the first update voltage for which the actuation current is equal to or greater than an actuation threshold (stage 502D). For example, while incrementally decreasing the first update voltage, if the magnitude of the actuation current $I_{act}$ reaches or exceeds an actuation current threshold, the controller 402 can stop any further decrease in the first update voltage. In some implementations, the actuation current threshold can be selected to be safely below a current value that may cause damage to the transistors, or other circuitry in the display apparatus 400. The controller 402 can store the value of the first update voltage that results in the actuation current to be equal to or exceed the actuation current threshold as the a first turn-on voltage $V_{TO1}$. The controller 402 can then determine the value of the minimum low first update voltage $V_{UPL-MIN}$ using the following Equation (1):

$$V_{UPL-MIN}=V_{TO1}+V_{ADJ1} \quad (1)$$

where $V_{ADJ1}$ is a first adjustment voltage that can be added to account for factors such as the subthreshold slope associated with the first discharge transistor 308, indicating the extent to which the gate source voltage of the first discharge transistor 308 needs to be below the threshold voltage to switch the first discharge transistor 308 completely in the OFF state. The first adjustment voltage $V_{ADJ1}$ also can account for any pattern-dependent changes to the voltage across the data capacitor 314, and for panel non-uniformity. The current threshold is chosen to switch the n first discharge transistors 308 into the ON state. Due to process variation, there is a non-uniform distribution of threshold voltages for which these transistors will switch from the OFF to the ON state. $V_{ADJ1}$ is chosen to be sufficiently large to accommodate the distribution variance between panels. The controller 402 can store the value of the minimum low first update voltage $V_{UPL-MIN}$ in memory. In some implementations, the value of the minimum low first update voltage $V_{UPL-MIN}$ can be about −5 V to about 1 V.

As mentioned above, FIG. 5C shows additional details of the stage 502 of the process 500 when testing the display apparatus 450 shown in FIG. 4B. As shown in FIG. 5C, determining a minimum low first update voltage $V_{UPL-MIN}$ (stage 502) includes loading data capacitors of all pixel circuits with logical low data voltage (stage 552A), setting the current source to draw a test current (stage 552B), and setting the minimum low first update voltage $V_{UPL-MIN}$ based the sensed voltage ($V_{TO1}'$) resulting from the test current (stage 552C).

Loading capacitors of all pixel circuits with a logical low data voltage (stage 552A) is similar to the stage 502A discussed above in relation to FIG. 5B. That is, the controller 402 can control the data drivers 410 and the row drivers 412 to load about 0 V into the data capacitor 314 of each of the pixel circuits 416 of the display apparatus 450. In some implementations, the controller 402 can initialize the voltage on the first update voltage interconnect 420 to a logical low data voltage. For example, the controller 402 can control the first update voltage driver 408 to output a logical low data voltage, for example 0 V and control the switch 460 into position A such that the voltage on the first update voltage interconnect 420 is initialized to the logical low data voltage. Thereafter, the controller 402 can control the switch 460 into position B to disconnect the first update voltage interconnect 420 from the first update voltage driver 408 and instead connect it to the current source 458.

The stage 502 further includes setting the current source to draw a test current (stage 552B). The controller 402 can set the value of the test current value to one that is safely below a current value that may cause damage to the transistors, or other circuitry in the display apparatus 450. In some implementations, the test current value can be set to about 100 μA to about 150 μA. As the current source 458 is connected to the display first update voltage interconnect 420, the test current drawn by the current source 458 can result in the switching ON of the first discharge transistors in one or more pixel circuits 416.

The stage 502 further includes setting the minimum low first update voltage $V_{UPL-MIN}$ based on the sensed voltage ($V_{TO1}'$) corresponding to the test current (stage 552C). The voltage sense module 452 measures the voltage on the display first update voltage interconnect 420 and communicates the measured voltage to the controller 402. In some implementations, the voltage sense module can include an ADC for converting the analog measurements into digital values. Alternatively, if the controller 402 is capable of ADC conversion, then the voltage sense module 452 can communicate the analog measured values to the controller 402. The controller 402 can then set the value of the minimum low first update voltage $V_{UPL-MIN}$ based on the voltage ($V_{TO1}'$) received from the voltage sense module 452. For example, the controller 402 can determine the minimum low first update voltage $V_{UPL-MIN}$ based on the following Equation (2):

$$V_{UPL-MIN}=V_{TO1}'+V_{ADJ1}' \quad (2)$$

where the adjustment voltage $V_{ADJ1}'$ serves as similar function to $V_{ADJ1}$ discussed in relation to FIG. 5B and also accommodates subthreshold slope, pattern-dependent changes to the voltage across the data capacitor 314, panel non-uniformity and any other factor that might lead to a difference between the measured $V_{TO1}'$ and the true $V_{UPL-MIN}$.

The process 500, based on whether the testing approach depicted in FIG. 4A or depicted in FIG. 4B is used, can utilize the appropriate value of the minimum low first update voltage $V_{UPL-MIN}$ determined in stage 502D (FIG. 5B) and stage 552C (FIG. 5C).

The process 500 further includes determining a maximum low first update voltage $V_{UPL-MAX-p}$ for p portions of the array of display elements (stage 504). In particular, the controller 402 can separately test each of the p portions of the array of display elements 404 and determine the maximum low first update voltage $V_{UPL-MAX-p}$ for each of the p portions. In some implementations, where the display apparatus 400 shown in FIG. 4A is used for testing, the controller 402 can determine the value for the maximum low first update voltage $V_{UPL-MAX-p}$ in a manner similar to the determination of the value for the minimum low first update voltage $V_{UPL-MIN}$, in that the controller 402 can reduce the first update voltage until the actuation current is equal to or greater than an actuation current threshold. However, unlike determining the minimum low first update voltage $V_{UPL-MIN}$, where both the data voltage and the first update voltage are initially set to 0 V, in determining $V_{UPL-MAX-p}$, the controller 402 initially sets the data voltage and the first update voltage to a logical high value (such as about 2 V to about 9 V or, for example, about 5-6 V). Further, unlike determining the minimum low first update voltage $V_{UPL-MIN}$, in which the all the pixel circuits 416 are tested simultaneously, in determining the maximum low first update voltage $V_{UPL-MAX-p}$ the controller 402 separately tests portions p or groups of pixel circuits 416 within the plurality of pixel circuits 416.

As shown in FIG. 5D, determining a maximum low first update voltage $V_{UPL-MAX-p}$ for p portions of the array of display elements (stage 504) includes selecting one of p portions of the plurality of pixel circuits (stage 504A). In some implementations, the controller 402 can select portions p of the plurality of pixel circuits 416 in the manner shown in FIG. 4A. For example, the controller 402 can test nine different portions p (shown within broken lines) of the plurality of pixel circuits 416 and determine the maximum low first update voltage $V_{UPL-MAX-p}$ for each of the nine portions. A person having ordinary skill in the art will readily understand that the controller 402 may select a different number of portions p or different number of pixel circuits 416 within each of the portions p. In some implementations, the number of portions p of the plurality of pixels can be equal to about 4 to about 1000. In some implementations, the number of pixels within a portion can be about 40×40 pixels, or about 20×20 pixels, or any other number of pixels that may be appropriate for testing.

In some implementations, the controller 402 can select a portion p of pixel circuits 416 by loading each of the pixel circuits 416 within the portion p with a current logical high voltage $V_{CH}$, and loading each of the remainder of the pixel circuits 416, which do not belong to the selected portion p, with a logical low voltage (stage 504B). For example, the controller 402 can use the row drivers 412 and the data drivers 410 to load a current logical high data voltage in the data capacitors 314 of the pixel circuits 416 within the top-left portion p of the plurality of pixel circuits 416 and load the data capacitors 314 of the remainder of the pixel circuits 416 with a logical low voltage (such as about 0 V). As shown in FIG. 5A, the process 500 can execute the stage 504 after updating the value of the logical high data voltage $V_{CH}$ in stage 512. In such instances, the current value of the logical high data voltage $V_{CH}$ is the updated value of $V_{CH}$ determined in stage 512. Therefore, if the controller 402 executes stage 504 after executing stage 512, the controller 402 in stage 504B can load each of the pixels in the portion p with the updated value of the logical high data voltage $V_{CH}$. On the other hand, if the controller 402 executes the stage 504 for the first time, the current value of the logical high data voltage $V_{CH}$ can be equal to an initial value of the logical high data voltage (such as about 5 V to about 7 V).

Determining a maximum low first update voltage $V_{UPL-MAX-p}$ for p portions of the array of display elements (stage 504) further includes setting a first update voltage to be substantially equal to the current logical high data voltage $V_{CH}$ (stage 504C). In some implementations, the controller 402 can control the first update voltage driver 408 to output a voltage that is equal to the current logical high data voltage $V_{CH}$ stored in the data capacitors 314 of the pixel circuits 416 within the portion p. The controller 402 also can control the pre-charge signal driver 424 to output a voltage that can switch ON the first charge transistor 306 and the second charge transistor 310. Thus, for each pixel circuit 416 within the portion p, both the gate terminal and the source terminal of the first discharge transistor 308 are at substantially the same voltage. As a result, the first discharge transistor 308 would be in an OFF state, which cuts off a current path from the actuation voltage interconnect 330 to the first update interconnect 328.

At the same time, the controller 402 can control the second update voltage driver 470 to output a voltage that is substantially equal to the actuation voltage. This results in the second discharge transistor 312 from switching ON, thereby preventing the possibility of any current flow though a path including the second charge transistor 310 and the second discharge transistor 312.

In some implementations, the first discharge transistor 308 might have a negative threshold voltage, which can result in the first discharge transistor 308 to switch ON and allow current flow even when both gate and source terminals of the first discharge transistor 308 are at the same voltage. In some such implementations, the controller 402 can control the first update voltage driver 408 to set the starting value for the first update voltage to a voltage that is higher than the logical high data voltage, for instance the high first update voltage, to ensure that the first discharge transistor 308 starts in the OFF or low-current state.

Determining a maximum first update voltage $V_{UPL-MAX-p}$ for p portions of the array of display elements (stage 504) further includes incrementally decreasing the first update voltage while sensing the actuation current (stage 504D). In some implementations, the controller 402 can then control the first update voltage driver 408 to incrementally reduce the first update voltage provided to the first update interconnect. The incremental decrease in the first update voltage on the first update interconnect 328 results in an incremental increase in the voltage difference between the gate and the source terminals of the first discharge transistor 308 of each pixel circuit 416 within the portion p. As the first update voltage decreases further, the voltage differences between the gate and the source terminals of one or more first discharge transistors 308 within the portion p may become equal to or exceed their respective threshold voltages. This can result in these first discharge transistors 308 switching ON, causing the actuation current $I_{act}$ to flow from the actuation voltage interconnect 330, via the first charge transistors 306 and the first discharge transistors 308, to the first update interconnect 328. As the first update voltage is decreased further, the first discharge transistors 308 of more pixel circuits 416 within the portion p may switch ON, and those transistor that are already on see higher gate-to-source bias, resulting in an increase in the magnitude of the actuation current $I_{act}$ between the actuation voltage interconnect 330 and the first update interconnect 328. The controller 402 can monitor the magnitude of the actuation current $I_{act}$ with each incremental decrease in the first update voltage.

Determining a maximum low first update voltage $V_{UPL\text{-}MAX\text{-}p}$ for p portions of the array of display elements (stage 504) further includes setting the maximum low first update voltage $V_{UPL\text{-}MAX\text{-}p}$ for the $p^{th}$ portion of the pixel circuits based on the first update voltage for which the actuation current is equal to or greater than an actuation threshold current (stage 504E). In some implementations, when the magnitude of the actuation current $I_{act}$ is greater than or equal to an actuation current threshold, the controller 402 can cease decreasing the first update voltage any further. The controller 402 can store the value of the first update voltage, for which the actuation current $I_{act}$ becomes equal to or exceeds the actuation current threshold, as the second turn-on voltage $V_{TO2\text{-}p}$. The controller 402 can then determine the value of the maximum low first update voltage $V_{UPL\text{-}MAX\text{-}p}$ for the portion p using the following Equation (3):

$$V_{UPL\text{-}MAX\text{-}p}=V_{TO2\text{-}p}+V_{ADJ2} \tag{3}$$

where $V_{ADJ2}$ is a second adjustment voltage that can be added to account for factors such as the transconductance of the first discharge transistor 308, indicating the extent to which the gate source voltage of the first discharge transistor 308 needs to be above the threshold voltage to ensure that the first discharge transistor 308 is sufficiently ON to discharge Node A. The second margin voltage $V_{ADJ2}$ also can account for any pattern-dependent changes to the voltage across the data capacitor 314, and for panel non-uniformity in a similar manner to $V_{ADJ1}$. In some implementations, the second margin voltage $V_{ADJ2}$ can be selected to be about 3 V to about −5 V or, for example, about 0 V to about −2 V.

Determining a maximum low first update voltage $V_{UPL\text{-}MAX\text{-}p}$ for p portions of the array of display elements (stage 504) further includes repeating the above process of determining the maximum low first update voltage $V_{UPL\text{-}MAX\text{-}p}$ for the $p^{th}$ portion, for each of the remainder of the p portions of the plurality of pixel circuits (stage 504F). In particular, the controller 402 repeats the stages 504A, 504B, 504C, 504D, and 504E to determine the maximum low first update voltage $V_{UPL\text{-}MAX\text{-}p}$ for each of the remainder of the p portions of the plurality of pixel circuits 416. The controller 402 also can store in memory the values of the maximum low first update voltage $V_{UPL\text{-}MAX\text{-}p}$ determined for each portion p.

In some implementations, where the display apparatus 450 shown in FIG. 4B (instead of the display apparatus 400 shown in FIG. 4A) is utilized for testing, determining a maximum low first update voltage $V_{UPL\text{-}MAX\text{-}p}$ for p portions of the array of display elements (stage 504) can include process stages shown in FIG. 5E. The process includes selecting one of p portions of the plurality of pixel circuits (stage 554A), and loading data capacitors of the pixel circuits within the $p^{th}$ portion with a current value of $V_{CH}$ (stage 554B). The manner in which the controller 402 selects the portions p and the pixel circuits 416 within each portion p can be similar to that discussed above in stages 504A and 504B in FIG. 5D.

Determining a maximum low first update voltage $V_{UPL\text{-}MAX\text{-}p}$ for p portions of the array of display elements (stage 504) further includes setting the current source to draw a test current (554C). The controller 402 can set the current source 458 (FIG. 4B) to draw a test current. In some implementations the test current can be set to about 400 μA to about 600 μA, or about 500 μA for a portion p including about 40×40 pixels. In some implementations, the controller 402 can set the test current to be a function of the size (in number of pixels) of the portion p. For example, in some implementations, the controller 402 can set the current source to draw a current that is equal to about 325 nA per pixel in the portion p.

Determining a maximum low first update voltage $V_{UPL\text{-}MAX\text{-}p}$ for p portions of the array of display elements (stage 504) further includes setting the maximum low first update voltage $V_{UPL\text{-}MAX\text{-}p}$ for the $p^{th}$ portion of the pixel circuits based on the measured first update voltage resulting from the test current (stage 554D). The controller 402, after setting the current source 458 to draw the test current, can receive the measured value of the first update voltage $V_{TO2}'$ from the differential voltage sensor 454. The controller 402 can estimate the maximum low first update voltage $V_{UPL\text{-}MAX\text{-}p}$, based on the following Equation (4):

$$V_{UPL\text{-}MAX\text{-}p}=V_{TO2\text{-}p}'+V_{ADJ2}' \tag{4}$$

where the adjustment voltage $V_{ADJ2}'$ serves a similar function to $V_{ADJ2}$ discussed above in relation to Equation (3), and can be selected to be about 0 V to about −2 V.

Determining a maximum low first update voltage $V_{UPL\text{-}MAX\text{-}p}$ for p portions of the array of display elements (stage 504) further includes repeating the above process of determining the maximum low first update voltage $V_{UPL\text{-}MAX\text{-}p}$ for the $p^{th}$ portion, for each of the remainder of the p portions of the plurality of pixel circuits (stage 554E). In particular, the controller 402 repeats the stages 554A, 554B, 554C, and 554D to determine the maximum low first update voltage $V_{UPL\text{-}MAX\text{-}p}$ for each of the remainder of the p portions of the plurality of pixel circuits 416. The controller 402 also can store in memory the values of the maximum low first update voltage $V_{UPL\text{-}MAX\text{-}p}$ determined for each portion p.

Referring again to FIG. 5A, the process 500 further includes selecting the least value of the maximum low first update voltage $V_{UPL\text{-}MAX}$ among all $V_{UPL\text{-}MAX\text{-}p}$ values (stage 506). In some implementations, the controller 402 can compare the values of all the maximum low first update voltage $V_{UPL\text{-}MAX\text{-}p}$ determined in stage 504 and select the lowest value (denoted as $V_{UPL\text{-}MAX}$). If the testing uses the display apparatus 400 shown in FIG. 4A, then the controller 402 can select the lowest value of the maximum low first update voltage $V_{UPL\text{-}MAX}$ among all $V_{UPL\text{-}MAX\text{-}p}$ values determined using the process shown in FIG. 5D. If however, the display apparatus 450 shown in FIG. 4B is used for testing the pixel circuits, then the controller 402 can select the lowest value of the maximum low first update voltage $V_{UPL\text{-}MAX}$ among all $V_{UPL\text{-}MAX\text{-}p}$ values determined using the process shown in FIG. 5E instead.

The process further includes selecting the value for low first update voltage to be between the estimated minimum low first update voltage $V_{UPL\text{-}MIN}$ and the least of all the maximum low first update voltage $V_{UPL\text{-}MAX\text{-}p}$ values (stage 516). In some implementations, the controller 402 can determine the value for the low first update voltage ($V_{UPL}$) using Equation (5):

$$V_{UPL}=V_{UPL\text{-}MIN}+\beta V_{UPL\text{-}RANGE} \tag{5}$$

where $V_{UPL\text{-}RANGE}$ is equal to $\min(V_{UPL\text{-}MAX\text{-}p})-V_{UPL\text{-}MIN}$, and β is a scalar multiplier having a range between about 0 to about 1. For example, selecting the value of β to be equal to 0.5 would result in the selected value of the low first update voltage $V_{UPL}$ to be midway between the estimated value of $V_{UPL\text{-}MIN}$ and the value of $\min(V_{UPL\text{-}MAX\text{-}p})$; selecting a value of 0 for β would result in the selected value of $V_{UPL}$ to be equal to the estimated value of $V_{UPL\text{-}MIN}$; and selecting a value of 1 for β would result in the selected value of $V_{UPL-MIN}$ to be equal to the value of min($V_{UPL-MAX-p}$). In some implementations, $V_{UPL-RANGE}$ is equal to the magnitude of the difference between min($V_{UPL-MAX-p}$) and $V_{UPL-MIN}$. In some such implementations, $V_{UPL-RANGE}$ is a positive value.

In some implementations, where only tuning the low first update voltage $V_{UPL}$ is needed, without tuning the value of the logical high data voltage, the process 500 can end at stage 516. However, if tuning of the value of the logical high data voltage is also desired, then the process 500 can be executed to additionally include stages 508, 510, 512, and 514, discussed further below.

The process 500 also includes updating the values of the low first update voltage range $V_{UPL-RANGE}$ (stage 508). In some implementations, the values of the low first update voltage range $V_{UPL-RANGE}$ can be determined in a manner similar to that discussed above in relation to stage 516. That is, $V_{UPL-RANGE}$ is equal to min ($V_{UPL-MAX-p}$)−$V_{UPL-MIN}$. In some implementations, $V_{UPL-RANGE}$ can be about 0 V to about 3 V.

The process 500 further includes determining whether the absolute difference between the low first update voltage range $V_{UPL-RANGE}$ is and the target range $V_{UPL-RANGE-TARGET}$ is less than a convergence threshold voltage ($V_{UPL-TH}$) (stage 510). In some implementations, the controller 402 can make this determination based on the following Equation (6):

$$\text{abs}(V_{UPL-RANGE}-V_{UPL-RANGE-TARGET})<V_{UPL-TH} \quad (6)$$

In some implementations, the target range $V_{UPL-RANGE-TARGET}$ can be about 0.2 V to about 1 V and the convergence threshold voltage $V_{UPL-TH}$ can be about 0.05 V to about 0.2 V. In some implementations, if the absolute difference between the low first update voltage range $V_{UPL-RANGE}$ and the target range $V_{UPL-RANGE-TARGET}$ is less than or equal to the convergence threshold voltage $V_{UPL-TH}$ then the controller 402 can determine that the current value of $V_{CH}$ is acceptable. If, however, the absolute difference between the first update voltage range $V_{UPL-RANGE}$ and the target range $V_{UPL-RANGE-TARGET}$ is greater than the convergence threshold voltage $V_{UPL-TH}$ then the controller 402 can continue executing the process 500.

The process 500 additionally includes adjusting the current value for the logical high data voltage $V_{CH}$ if the absolute difference between the low first update voltage range $V_{UPL-RANGE}$ and the target range $V_{UPL-RANGE-TARGET}$ is not less than the convergence threshold voltage $V_{UPL-TH}$ (stage 512). In some implementations, the controller 402 can adjust the value of the logical high data voltage $V_{CH}$ based on the following Equation (7):

$$V_{CH-NEW,}=V_{CH-OLD}-\alpha(V_{UPL-RANGE}-V_{UPL-RANGE-TARGET}) \quad (7)$$

where $V_{CH-NEW}$ and $V_{CH-OLD}$ represent the new and old values of the logical high data voltage $V_{CH}$, and α represents a scalar multiplier. In some implementations, for example, the value of α can range from about 0 to about 1. For example, in some implementations, where α is equal to 1, the controller 402 can reduce the value of the logical high data voltage $V_{CH}$ by the difference between the low first update voltage range and the target range.

After updating the current value of the logical high data voltage $V_{CH}$, the controller 402 can proceed to re-determine the values for the maximum low first update voltage $V_{UPL-MAX-p}$ for each of the p portions, as discussed above in relation to stage 504. However, in re-determining the values for the maximum low first update voltage $V_{UPL-MAX-p}$, the controller 402 adjusts the values of the data voltages stored in the data capacitors 314 and the value of the first update voltage on the first update interconnect 328 for each portion p to be substantially equal to the updated logical high data voltage $V_{CH}$ determined in Equation (7) (stage 512). Based on the re-determined values for the maximum low first update voltages $V_{UPL-MAX-p}$, the controller 402 can re-determine the value of $V_{UPL-MAX}$ (the least value of all p values of the maximum low first update voltage $V_{UPL-MAX-p}$ (stage 506)). The controller 402 can then update the values of low first update voltage range $V_{UPL-RANGE}$ (stage 508) and determine whether the absolute difference between the low first update voltage range $V_{UPL-RANGE}$ and the target range $V_{UPL-RANGE-TARGET}$ is less than or equal to the convergence threshold voltage $V_{UPL-TH}$ (stage 510). If the absolute difference between the low first update voltage range $V_{UPL-RANGE}$ and the target range $V_{UPL-RANGE-TARGET}$ is not less than the convergence threshold voltage $V_{UPL-TH}$, then the controller 402 can again adjust the value of the logical high data voltage $V_{CH}$ as per Equation (7) and repeat the stages 504, 506, 516, 508, 510, and 512, until the absolute difference between the low first update voltage range $V_{UPL-RANGE}$ and the target range $V_{UPL-RANGE-TARGET}$ is less than or equal to the convergence threshold voltage $V_{UPL-TH}$.

The process 500 additionally includes stopping and using the current value of the logical high data voltage $V_{CH}$ if absolute difference between the low first update voltage range $V_{UPL-RANGE}$ and the target range $V_{UPL-RANGE-TARGET}$ is less than the convergence threshold voltage ($V_{UPL-TH}$) (stage 514). At this stage, the value of the logical high data voltage $V_{CH}$ can be considered as the minimum data voltage $V_{CH}$ corresponding to logical high data needed for reliable operation of the display apparatus 400 (FIG. 4A) or the display apparatus 450 (FIG. 4B).

In some implementations, the controller 402 can execute the process 500 during start-up of the display apparatus. In some implementations, the controller 402 can execute the process 500 repeatedly over time. In some implementations, the controller 402 can execute the process 500 upon detecting changes in ambient temperature. In some implementations, the controller 402 can execute the process 500 upon detecting changes in ambient light conditions.

In some implementations, all voltage levels mentioned above can be referenced with respect to a low data voltage of about 0 V.

Figure 6A:
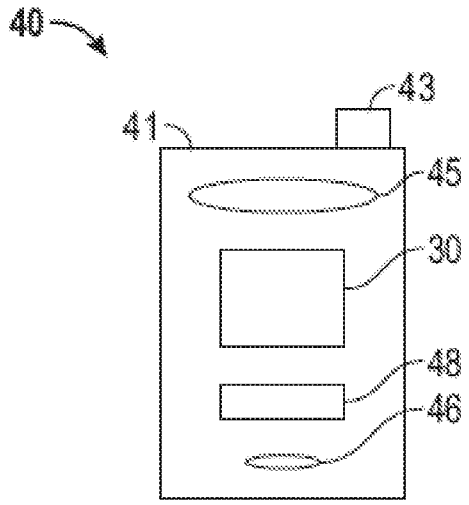
FIGS. 6A and 6B show system block diagrams of an example display device that includes a plurality of display elements.
Figure 6B:
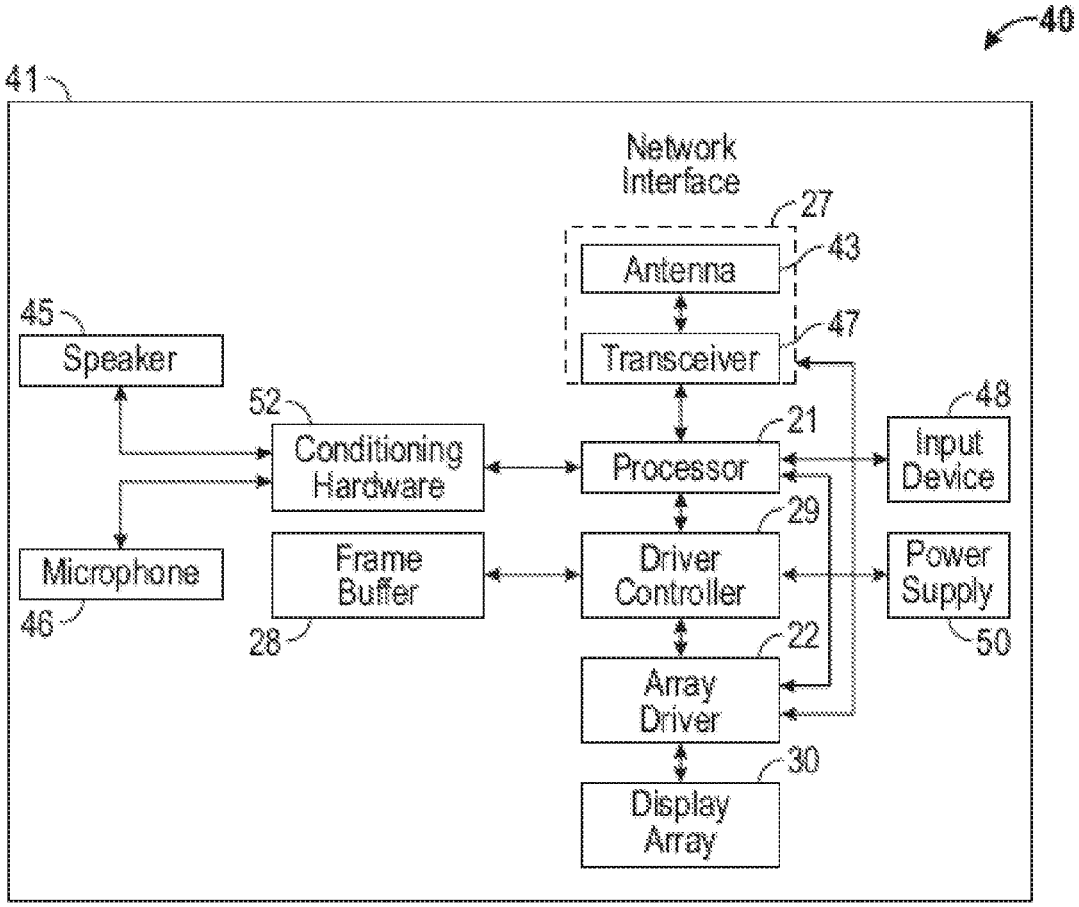

FIGS. 6A and 6B show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be capable of including a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 6B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 6A, can be capable of functioning as a memory device and be capable of communicating with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to any of the IEEE 16.11 standards, or any of the IEEE 802.11 standards. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1×EV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G, or further implementations thereof, technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29 is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40. Additionally, in some implementations, voice commands can be used for controlling display parameters and settings.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware, software, or both hardware and software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A display apparatus, comprising:

a plurality of light modulators capable of selectively allowing passage of light;

a plurality of pixel circuits, each pixel circuit including:

an output node coupled to a corresponding light modulator of the plurality of light modulators, a charge transistor configured to charge the output node from an actuation interconnect, and a discharge transistor configured to selectively conduct a current between the output node and an update interconnect;

an update interconnect driver configured to output voltages to the update interconnects of the plurality of pixel circuits; and a controller coupled to the plurality of pixel circuits configured to:

determine a low update voltage to apply to the update interconnects by:

causing the charge transistors of the plurality of pixel circuits to enter a conductive state, and while the charge transistors of the plurality of pixel circuits are in the conductive state, determining a plurality of voltage levels provided to the update interconnects that cause the discharge transistor of at least one of the plurality of pixel circuits to conduct current.

2. The display apparatus of claim 1, further comprising a current sensor coupled to the controller for sensing a level of the current flowing through at least one of the update interconnects and the actuation interconnect and providing the level to the controller.

3. The display apparatus of claim 1, wherein the plurality of update voltage levels provided to the update interconnect include:

a first voltage level of the plurality of voltage levels provided to the update interconnects determined while a logical low data voltage is applied to the gates of the discharge transistors of the plurality of pixel circuits, and a second voltage level of the plurality of voltage levels provided to the update interconnects determined while a logical high data voltage is applied to the gates of the discharge transistors of a portion of the plurality of pixel circuits; and wherein the low update voltage is determined to be a voltage between the first voltage level and the second voltage level.

4. The display apparatus of claim 3, wherein the controller is further configured to:

control the update interconnect driver to output a voltage on the update interconnects that switches OFF the discharge transistors of the plurality of pixel circuits, control the update interconnect driver to incrementally reduce the voltage on the update interconnects to a first turn-on voltage that causes a level of current flowing through at least one of the update interconnects and the actuation interconnect to be equal to or greater than a first actuation current threshold, and set the first voltage level based on the first turn-on voltage.

5. The display apparatus of claim 4, wherein the controller is further configured to set the first voltage level to a sum of the first turn-on voltage and a first adjustment voltage.

6. The display apparatus of claim 3, further comprising:

a current source coupled to the update interconnects of the plurality of pixel circuits;

wherein the controller is further configured to:

control the current source to draw a test current, and set the first voltage level based on a voltage on the update interconnects corresponding to the test current.

7. The display apparatus of claim 3, wherein the controller is further configured to:

determine the second voltage level by sequentially, across a plurality of portions of the plurality of pixel circuits:

applying the logical high data voltage to the gates of discharge transistors of a respective portion of the plurality of pixel circuits; and determining a maximum update voltage at which one or more of the discharge transistors of the pixel circuits in the respective portion of the plurality of pixel circuits are conductive, and set the lowest voltage of the determined maximum update voltages as the second voltage level.

8. The display apparatus of claim 3, wherein the controller is further configured to:

determine the second voltage level by sequentially, across a plurality of portions of the plurality of pixel circuits:

applying the logical high data voltage to the gates of discharge transistors of a respective portion of the plurality of pixel circuits;

controlling the current source to draw a test current from the respective portion of the plurality of pixel circuits; and measuring a maximum update voltage at the update interconnects of the respective portion of plurality of pixel circuits, and set the second voltage level based on the lowest voltage of the measured maximum update voltages.

9. The display apparatus of claim 8, wherein, when testing the respective portion of the plurality of pixel circuits, the controller is further configured to apply the logical low data voltage to the gates of the discharge transistors of those pixel circuits that do not belong to the respective portion of the plurality of pixel circuits.

10. The display apparatus of claim 3, wherein the controller is further configured to utilize the first voltage level and the second voltage level to determine a logical high data voltage level.

11. The display apparatus of claim 10, wherein the controller is further configured to determine the logical high data voltage level by:

determining a range of update voltages based on a difference between the first voltage level and the second voltage level;

determining a revised logical high data voltage level by sequentially, until an absolute difference between the range of update voltages and a target range is less than a voltage threshold:

adjusting a current value of the logical high data voltage based on the difference between the range of update voltage and the target range from a current value of the logical high data voltage level to generate a revised logical high data voltage level, re-determining the second voltage level by using the revised logical high data voltage for applying to the gates of the discharge transistors of the respective portions of the plurality of pixel circuits, and re-determining the range of update voltages; and setting the revised logical high data voltage as the logical high data voltage level.

12. The display apparatus of claim 1, wherein the plurality of update voltage levels provided to the updates interconnects include:

a first voltage level of the plurality of voltage levels provided to the update interconnects, the first voltage level being a lowest voltage level for which none of the discharge transistors of the plurality of pixel circuits conducts a sufficient current to discharge the respective output nodes when a logical low data voltage is applied to the gates of the discharge transistors of the plurality of pixel circuits, and a second voltage level of the plurality of voltage levels provided to the update interconnects, the second voltage level being a highest voltage level for which all the discharge transistors of the plurality of pixel circuits conduct sufficient current to discharge the respective output nodes when a logical high data voltage is applied to the gates of the discharge transistors of the plurality of pixel circuits, and wherein the low update voltage is determined to be a voltage between the first voltage level and the second voltage level.

13. The display apparatus of claim 1, further comprising:

a display including:

the plurality of light modulators, the update interconnects, the plurality of pixel circuits, and the controller;

a processor that is capable of communicating with the display, the processor being capable of processing image data; and a memory device that is capable of communicating with the processor.

14. The display apparatus of claim 13, the display further including:

a driver circuit capable of sending at least one signal to the display; and wherein the controller is further capable of sending at least a portion of the image data to the driver circuit.

15. The display apparatus of claim 13, further including:

an image source module capable of sending the image data to the processor, wherein the image source module comprises at least one of a receiver, transceiver, and transmitter.

16. The display apparatus of claim 13, the display further including:

an input device capable of receiving input data and to communicate the input data to the processor.

17. A method for testing a display apparatus including a plurality of pixel circuits, each of the plurality of pixel circuits having an output node coupled to one of a plurality of light modulators, a charge transistor configured to charge the output node and a discharge transistor configured to selectively conduct a current between the output node and an update interconnect, comprising:

causing the charge transistors of the plurality of pixel circuits to enter a conductive state;

while the charge transistors of the plurality of pixel circuits are in the conductive state, determining a plurality of voltage levels provided to the update interconnects that cause the discharge transistor of at least one of the plurality of pixel circuits to conduct current; and processing the determined plurality of voltage levels to determine a low update voltage for applying to the update interconnects of the plurality of pixel circuits.

18. The method of claim 17, wherein determining a plurality of voltage levels provided to the update interconnects includes:

determining a first voltage level of the plurality of voltage levels provided to the update interconnects when a logical low data voltage is applied to the gates of the discharge transistors of the plurality of pixel circuits, and determining a second voltage level of the plurality of voltage levels provided to the update interconnects when a data voltage corresponding to a logical high data is stored in the first subset of the plurality of pixel circuits;

wherein processing the determined plurality of update voltage levels to determine a low update voltage for applying to the update interconnect includes equating the low update voltage to a voltage between the first voltage level and the second voltage level.

19. The method of claim 18, wherein determining the first voltage level includes:

applying an update voltage to the update interconnects that substantially switches OFF the discharge transistors of the plurality of pixel circuits;

incrementally reducing the update voltage on the update interconnects to a first turn-on voltage that causes a level of current flowing through at least one of the update interconnects and the actuation interconnect to be equal to or greater than a first actuation current threshold; and setting the first voltage level based on the first turn-on voltage.

20. The method of claim 18, wherein determining the first voltage level includes:

drawing a test current from the update interconnects and measuring a voltage at the update interconnects corresponding to the test current; and setting the first voltage level based on the measured voltage.

21. The method of claim 18, wherein determining the second voltage level includes:

for each portion of the plurality of pixel circuits:

applying a logical high data voltage to the gates of discharge transistors of a respective portion of the plurality of pixel circuits, and determining a maximum update voltage at which one or more of the discharge transistors of the pixel circuits in the respective portions of the pixel circuits are conductive, and setting the lowest voltage of the determined maximum update voltages as the second voltage level.

22. The method of claim 18, further comprising:

utilizing the first voltage level and the second voltage level to determine a logical high data voltage level for use in addressing the plurality of pixel circuits.

23. The method of claim 22, further comprising:

determining a range of update voltages based on a difference between the first voltage level and the second voltage level;

determining a revised logical high data voltage level by iteratively, until the difference between the range of update voltages and a target range is less than a voltage threshold:

adjusting a current value of the logical high data voltage based on the difference between the range of update voltages and the target voltage from a current value of the logical high data voltage level to generate a revised logical high data voltage level, re-determining the second voltage level by using the revised logical high data voltage for applying to the gates of the discharge transistors of the respective portions of the plurality of pixel circuits, and re-determining the range of update voltages; and setting the revised logical high data voltage as the logical high data voltage level.

24. The method of claim 22, wherein processing the determined plurality of voltage levels to determine a logical high data voltage level for use in addressing the plurality of pixel circuits includes addressing the plurality of pixel circuits by storing the logical high data voltage in a data capacitor coupled to the gates of the discharge transistors.

* * * * *